US012760985B2

(12) United States Patent
Shamblen et al.

(10) Patent No.: US 12,760,985 B2
(45) Date of Patent: Oct. 13, 2026

(54) ECCENTRICS FOR ARCHERY BOWS AND RELATED APPARATUSES

(71) Applicant: Hoyt Archery, Inc., Salt Lake City, UT (US)

(72) Inventors: Kevin T. Shamblen, West Jordan, UT (US); Dan'l J. Anselmo, South Jordan, UT (US); Gideon S. Jolley, Syracuse, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 144 days.

(21) Appl. No.: 18/606,034

(22) Filed: Mar. 15, 2024

(65) Prior Publication Data

US 2025/0290723 A1 Sep. 18, 2025

(51) Int. Cl.
*F41B 5/10* (2006.01)

(52) U.S. Cl.
CPC ..... *F41B 5/105* (2013.01)

(58) Field of Classification Search
CPC ..... F41B 5/10; F41B 5/105; F41B 5/1403; Y10S 124/90
USPC ..... 124/25.6, 900
See application file for complete search history.

(56) References Cited

U.S. PATENT DOCUMENTS

| | | | | |
|---|---|---|---|---|
| 6,415,780 | B1 * | 7/2002 | Proctor | F41B 5/10 124/900 |
| 6,964,271 | B2 * | 11/2005 | Andrews | F41B 5/10 267/153 |
| 7,938,109 | B1 * | 5/2011 | Larson | F41B 5/10 124/25.6 |
| 9,528,788 | B2 * | 12/2016 | McPherson | F41B 5/14 |
| 9,683,806 | B1 * | 6/2017 | Yehle | F41B 5/105 |
| 10,126,087 | B1 * | 11/2018 | Grace | F41B 5/123 |
| 11,486,674 | B2 * | 11/2022 | McPherson | F41B 5/1403 |
| 11,536,532 | B1 * | 12/2022 | Grace | F41B 5/1403 |
| 11,821,708 | B1 * | 11/2023 | Hansen | F41B 5/1403 |
| 12,130,112 | B1 * | 10/2024 | Hayes | F41B 5/1403 |
| 12,163,757 | B2 * | 12/2024 | Grace | F41B 5/10 |
| 12,467,712 | B2 * | 11/2025 | Strother | F41B 5/105 |
| 12,553,682 | B2 * | 2/2026 | Walthert | F41B 5/105 |
| 2020/0158461 | A1 * | 5/2020 | Romero | F41B 5/105 |
| 2025/0297826 | A1 * | 9/2025 | Strother | F41B 5/105 |

* cited by examiner

*Primary Examiner* — Alexander R Niconovich

(57) ABSTRACT

An archery bow includes a riser, a limb, an axle, and a cam assembly. The cam assembly can include a rotatable member and one or more bearings. The rotatable member can be laterally repositionable or laterally translatable to one of a plurality of positions relative to the one or more bearings. In some examples, the one or more bearings can be disposed within a bearing carriage assembly and the rotatable member can be laterally repositionable or laterally translatable to one of a plurality of positions relative to the bearing carriage assembly.

16 Claims, 29 Drawing Sheets

ECCENTRICS FOR ARCHERY BOWS AND RELATED APPARATUSES

TECHNICAL FIELD

The present disclosure generally relates to archery equipment and specifically relates to eccentrics for archery equipment.

BACKGROUND

Archery equipment, such as recurve bows, crossbows, and compound bows, are regularly used to launch arrows and other projectiles down range at one or more targets. Each archer can have unique physical attributes that impact operation of the archery bow. Some components of an archery bow can be manipulated or altered to better function for particular physical attributes of the archer. For example, a draw weight of the bow can be reduced or increased dependent upon an archer's strength and technique in drawing the bow. Archery bow components can be improved to advantageously effect an archer's shooting experience, performance, and overall satisfaction with the archery equipment.

SUMMARY

One aspect of the present disclosure relates to an archery bow including a riser, a limb, an axle, and a cam assembly. The axle is coupled to the limb. The axle defines an axis. The cam assembly is rotatably coupled to the axle. The cam assembly includes a rotatable member and a bearing. The rotatable member has a bore. The bearing is disposed within the bore. The rotatable member is configured to translate relative to the bearing to one of a plurality of positions. The plurality of positions extend along the axis.

In some examples, the rotatable member can be configured to translate relative to the axle while the bearing remains laterally fixed relative to the axle. In some examples, the rotatable member is disposed a first distance from the limb in a first position of the plurality of positions. The rotatable member can be disposed a second distance from the limb in a second position of the plurality of positions. The first distance can be less than the second distance. In some examples, the bearing can be disposed a third distance from the limb when the rotatable member is in the first position. The bearing can remain disposed the third distance from the limb when the rotatable member is in the second position.

In some examples, the cam assembly can further include a bearing carriage disposed within the bore. The bearing can be disposed within the bearing carriage. The rotatable member can be configured to translate relative to the bearing carriage to one of the plurality of positions. The bearing carriage can be removable from the bore. A shared fastener can engage the bearing carriage and the rotatable member. Rotation of the shared fastener can translate the rotatable member relative to the bearing carriage. The bearing carriage can have a lateral rim. The lateral rim can have a protrusion extending perpendicular to a longitudinal axis of the bearing carriage.

In some examples, the limb is a first limb and the archery bow can further include a second limb. The first limb and the second limb can be coupled to an upper portion or a lower portion of the riser. The cam assembly can include a first spacer and a second spacer. The first spacer can have a first thickness. The second spacer can have a second thickness. A combination of the first thickness and the second thickness can define a total spacer thickness. A total translation range of the rotatable member relative to the bearing can be greater than or equal to the total spacer thickness.

In some examples, the bearing can be a first bearing of a set of bearings disposed within the bore. The limb can be a first limb and the archery bow can further include a second limb. The first limb and the second limb can be coupled to an upper portion or a lower portion of the riser to form a gap between the first limb and the second limb. The set of bearings can include a second bearing. The first bearing can be displaced from the second bearing by a distance of at least 55% of the gap. In some examples, the distance can be at least 13 mm.

Another aspect of the present disclosure relates to an archery bow including a riser, a limb, an axle, and a cam assembly. The axle is coupled to the limb and defines an axis of rotation. The cam assembly is rotatably coupled to the axle. The cam assembly includes a rotatable member and a bearing. The rotatable member has a bore. The bearing is coupled to the axle. The rotatable member is configured to translate along the axis of rotation while the bearing is configured to remain in a static lateral position relative to the axle.

In some examples, the cam assembly can further include a bearing carriage disposed within the bore. The bearing can be disposed within the bearing carriage. The rotatable member can be configured to translate along the axis and relative to the bearing carriage to one of a plurality of positions. In some examples, the bearing carriage can be removable from the bore. In some examples, a shared fastener can engage the bearing carriage and the rotatable member. The shared fastener can be configured to rotate to translate the rotatable member relative to the bearing carriage.

Yet another aspect of the present disclosure relates to a cam assembly for an archery bow. The cam assembly includes a rotatable member, a bearing carriage, and a set of bearings disposed within the bearing carriage. The bearing carriage is configured to be removed from the rotatable member.

In some examples, the bearing carriage can be configured to retain the set of bearings when removed from the rotatable member. In some examples, a portion of an exterior surface of the bearing carriage can define a first engagement feature. A portion of an interior surface of the rotatable member can define a second engagement feature. A threaded fastener can contact the first engagement feature and the second engagement feature.

In some examples, a portion of an exterior surface of the bearing carriage can define a first engagement feature. A portion of an interior surface of the rotatable member can define a second engagement feature. A pin can contact the first engagement feature and the second engagement feature.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
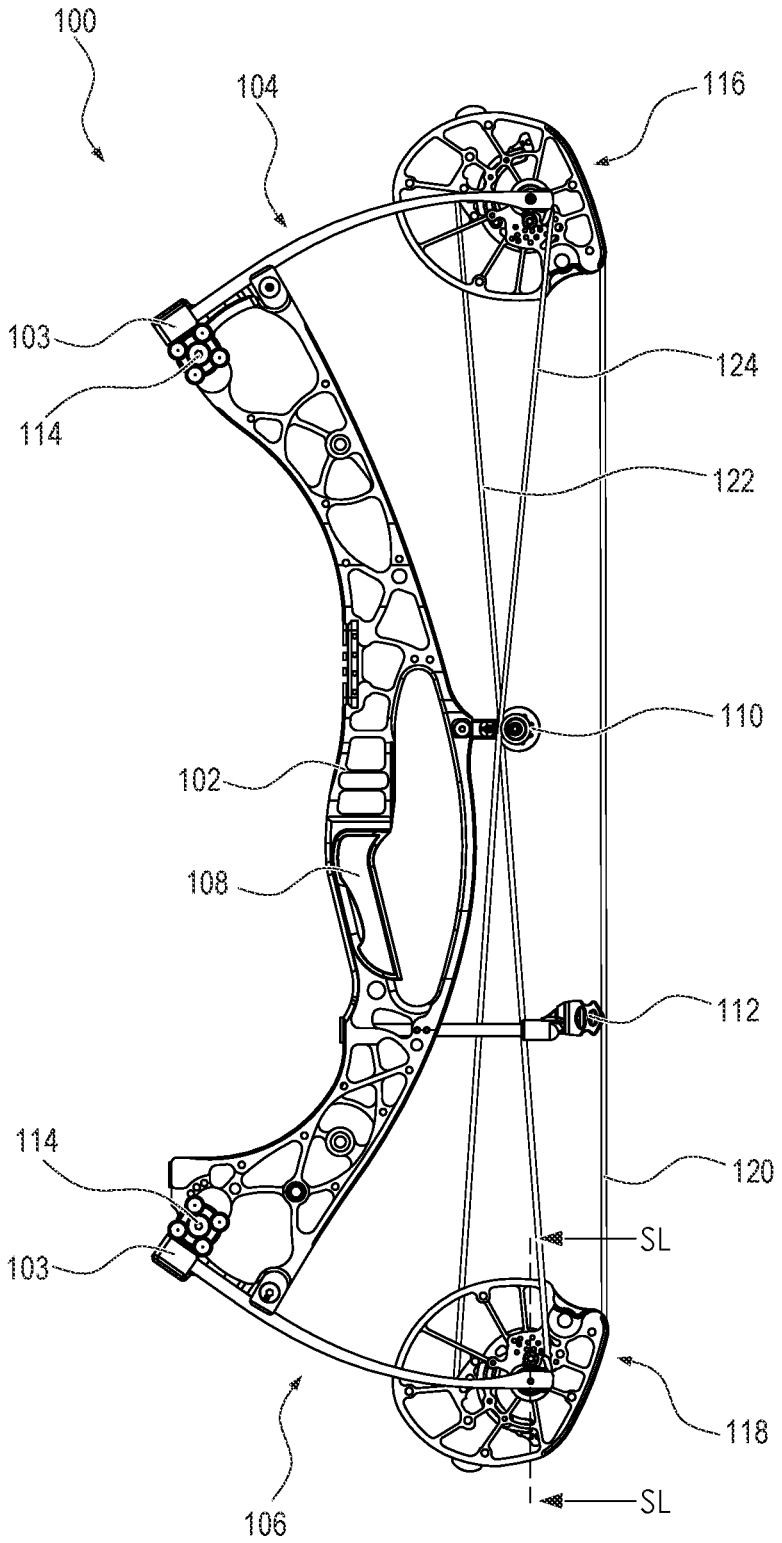
FIG. 1A is a side view of an archery bow, according to some embodiments.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Some archery bows (e.g., compound, cross, etc.) can have one or more cam assemblies. Each of these cam assemblies can include an eccentric or rotatable member which pays out and takes up strings and/or cables when the archery bow transitions between a brace state and a fully drawn state. According to aspects of the present disclosure, one or more of the rotatable members can be laterally repositioned or laterally adjusted to one of a plurality of positions relative to a bearing and/or bearing carriage. Lateral repositioning the rotatable member can enable an archer or bow technician to manipulate a bowstring plane and/or lean of the rotatable member to improve characteristics associated with arrow flight. For example, shifting or repositioning one or both of the rotatable members along the axle can alter or vary a moment induced on the cam assembly and therefore alter or vary a lean or camber of the cam assembly.

According to another aspect of the present disclosure, an archery bow can include one or more cam assemblies. Each cam assembly can include a rotatable member having a bearing carriage disposed within a bore defined by the rotatable member. The bearing carriage can house or retain one or more bearings which enable the cam assembly to rotate about an axle. In some examples, the bearing carriage can be removably coupled within the bore without requiring removal of the one or more bearings. In other words, the bearing carriage can act as a replaceable or swappable bearing cartridge or bearing clip. The bearing carriage can house the one or more bearings and enable bearing removal from the rotatable member without requiring a user to press bearings into, or out of, the bore of the rotatable member. Rather, the bearing carriage can be removable from the bore and a second bearing carriage (housing new bearings) can be slid or positioned within the bore to replace the first bearing carriage.

The present description provides examples, and is not limiting of the scope, applicability, or configuration set forth in the claims. Thus, it will be understood that changes may be made in the function and arrangement of the cam assemblies and limb assemblies discussed without departing from the spirit and scope of the disclosure, and various embodiments may omit, substitute, or add other features or subcomponents as appropriate. For instance, features described with respect to certain embodiments may be combined in other embodiments. The specific examples shown in the figures and described herein should not, therefore, be considered to limit the breadth of possible embodiments and combinations of possible embodiments contemplated by the present disclosure.

Referring now to the figures in detail, FIG. 1A shows a compound archery bow 100. The archery bow 100 is at a rest position (e.g., a brace state or brace position). The archery bow 100 can comprise a riser 102 from which one or more upper limbs 104 and one or more lower limbs 106 extend. For example, the upper limbs 104 can be affixed to the riser 102 by one or more limb pockets 103. The archery bow 100 can include a handle portion or grip 108, a roller guard or cable guard 110, a string-stop damper 112, dampers 114, and other components.

The upper limbs 104 may be connected to an upper cam assembly 116, and the lower limbs 106 may be connected to a lower cam assembly 118. A bowstring 120 (i.e., draw string) may extend across the length of the archery bow 100 between the upper cam assembly 116 and the lower cam assembly 118. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may also be attached to and extend between the upper cam assembly 116 and the lower cam assembly 118. Collectively, the first cable 122 and the second cable 124 may be referred to herein as the cables of the archery bow 100. The first and second cables 122, 124 may retain tension in the limbs 104, 106 and cam assemblies 116, 118 and may be controlled to adjust tension in the bowstring 120.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, and related methods and apparatuses included in embodiments of the present disclosure may be applied to components and apparatuses in compound bows, crossbows, their accessories, and other equipment related to archery. Similarly, archery equipment applying the teachings of the present disclosure does not need to implement all of the features of the present disclosure. For example, in some embodiments, the archery bow may not comprise a cable guard 110 or a string-stop damper 112, so features associated with those accessories may be omitted from the archery bow 100.

When shooting an arrow, the tail end of the arrow may be nocked with the bowstring 120 at a nocking point (not shown) while the archery bow 100 is in the brace position shown in FIG. 1A. The bowstring 120 may be drawn rearward to a full draw position, thereby partially unwinding the bowstring 120 from the outer grooves of the cam assemblies 116, 118. The archer may grasp the grip 108 of the riser 102 and draw back the bowstring 120 (e.g., by using a D-loop, not shown). As the limbs 104, 106 flex inward and the cables 122, 124 wind around the cam assemblies 116, 118, the cables 122, 124 may slide along or may be in rolling contact with portions of the cable guard 110, which may comprise at least one roller or other smooth support in contact with the cables 122, 124 where they contact the cable guard 110.

When the bowstring 120 is released, the potential/stored energy in the limbs 104, 106 is released, and the bowstring 120 quickly accelerates back toward the brace position (shown in FIG. 1A) as it applies a shooting force to an end of the projectile (e.g., an arrow). As the limbs 104, 106 release their energy, the cam assemblies 116, 118 are spread apart, and the terminal ends of the bowstring 120 wrap around the cam assemblies 116, 118, and the cables 122, 124 unwind from the cam assemblies 116, 118. A portion of the bowstring 120 may contact the string-stop damper 112, which can help dampen vibrations in the bowstring 120, and the cables 122, 124 may roll or slide against the cable guard 110 as the cam assemblies 116, 118 move.

Figure 1B:
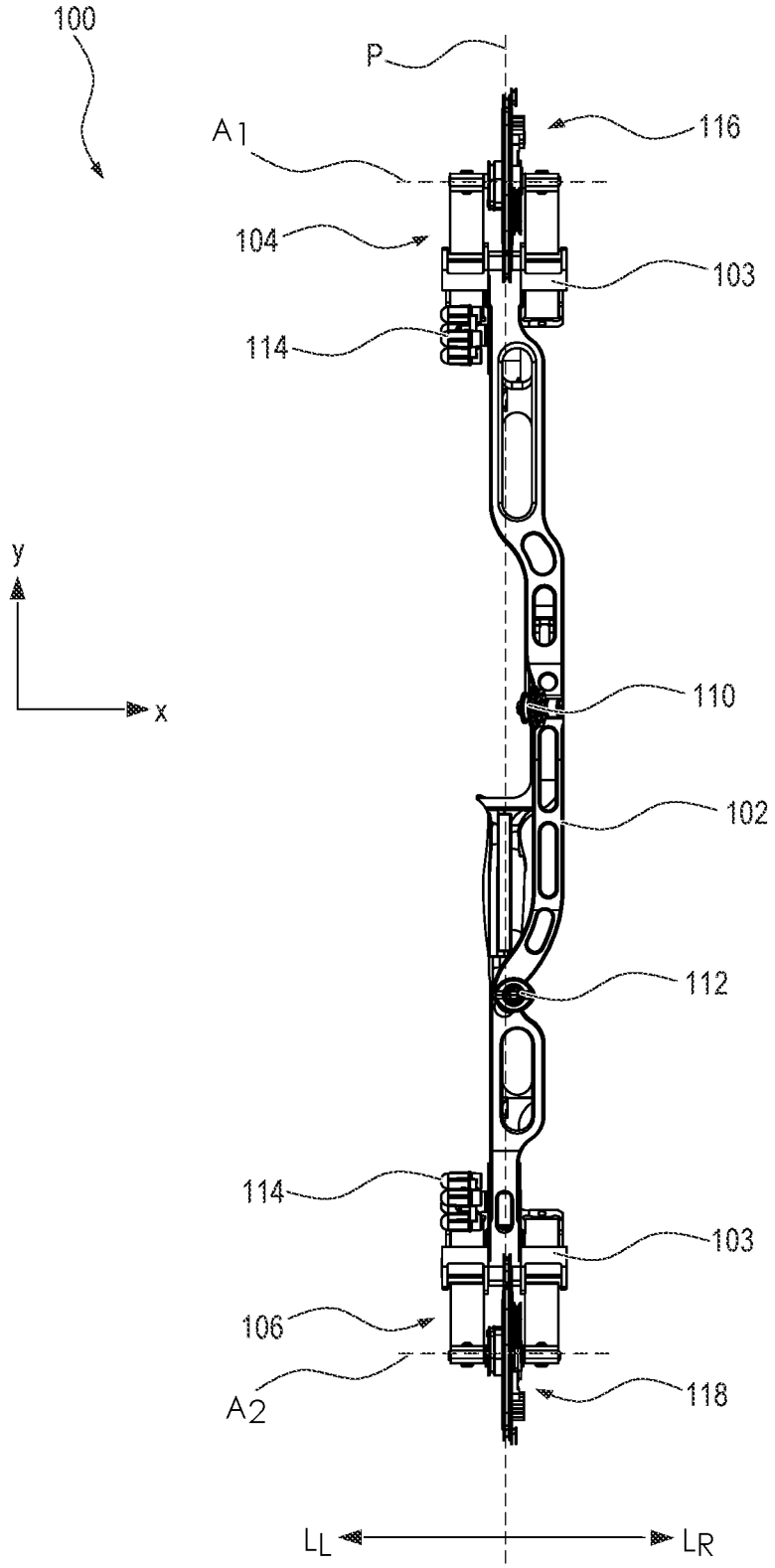
FIG. 1B is a rear view of the archery bow, according to some embodiments.

FIG. 1B shows the archery bow 100 with the bowstring 120 and the cables 122, 124 removed. FIG. 1B also shows a bowstring plane P extending from the respective bowstring grooves of the upper and lower cam assemblies 116, 118. In some examples, the bowstring plane P can correlate to a plane the bowstring 120 travels as the archery bow 100 is brought from a brace state (see FIG. 1A) to a fully-drawn state (not shown). In some examples, the bowstring plane P can be laterally repositionable or laterally adjustable (e.g., side-to-side) by repositioning respective rotatable members of one or both of the upper and lower cam assemblies 116, 118 relative to the upper and lower limbs 104, 106, respectively. The terms laterally adjustable or laterally repositionable can refer to varying the position of the respective cam assembly to the lateral left (e.g., direction arrow $L_L$ shown in FIG. 1B) or to the lateral right (e.g., direction arrow $L_R$ shown in FIG. 1B). The direction of translation or movement of the cam assembly in the direction of the arrows $L_L$, $L_R$ can be orthogonal or substantially orthogonal to the bowstring plane P and coincide or correlate with the x-axis direction (see the cartesian axes shown in FIG. 1B). In some examples, one or both of the upper and lower cam assemblies 116, 118 can be laterally repositionable or laterally adjustable along axes $A_1$, $A_2$ defined by respective axles (see axle 208 in FIG. 2B). The axes $A_1$, $A_2$ can be parallel with the lateral direction arrows $L_L$, $L_R$.

Laterally repositioning or laterally adjusting the rotatable member of a cam assembly can enable an archer or bow technician to manipulate the bowstring plane P to improve characteristics of arrow flight associated with the arrow detaching or launching from the bowstring. For example, laterally repositioning or laterally adjusting one or both of the rotatable members can vary a roll or lean exhibited by the rotatable member (i.e., cam lean) to improve performance characteristics of the archery bow. Laterally repositioning or laterally adjusting rotatable members will described herein with reference to FIGS. 2A-5E.

Figure 2A:
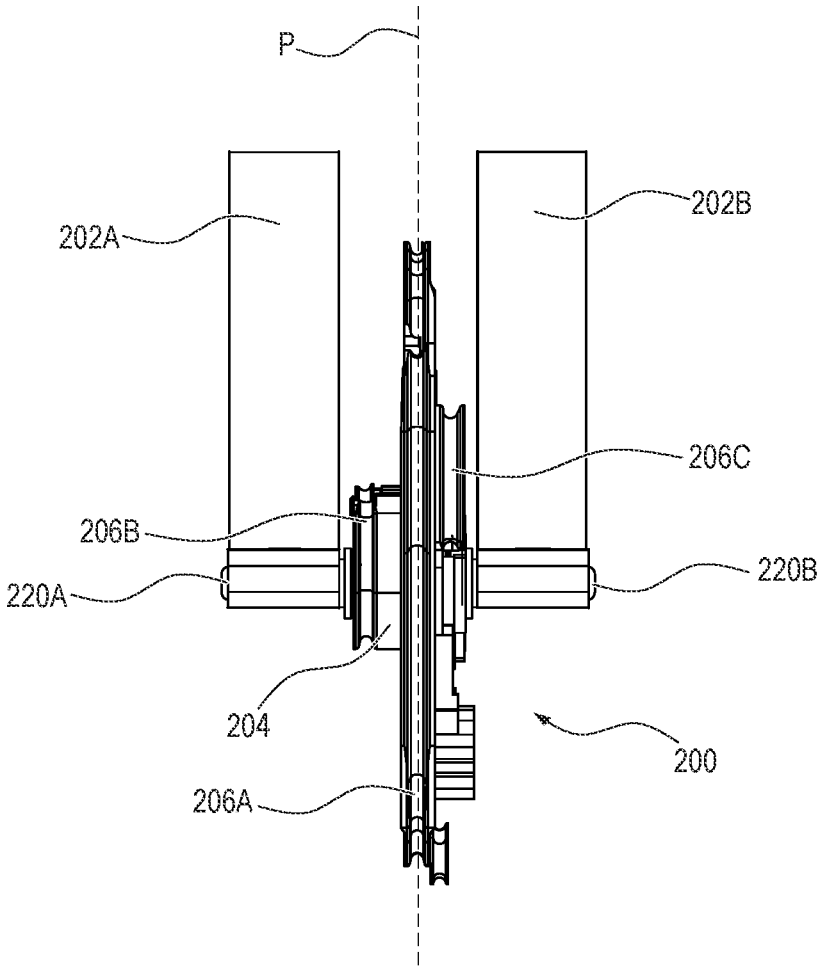
FIG. 2A is a detailed rear view of a cam assembly and limbs of an archery bow, according to some embodiments.

FIG. 2A shows a rear view of a cam assembly 200 rotatably coupled to a first limb 202A and a second limb 202B. The cam assembly 200 can be substantially similar to, and can include some or all of, the features of the upper cam assembly 116 or the lower cam assembly 118 shown in FIGS. 1A-1B. For example, the cam assembly 200 can include a rotatable member 204 at least partially defining a bowstring plane P. The rotatable member 204 can include a bowstring groove 206A and one or more cable grooves 206B, 206C. The bowstring plane P can be at least partially disposed within the bowstring groove 206A. The rotatable member 204 can be repositionable relative to one or more bearings (see FIG. 2B) of the cam assembly 200 such that the rotatable member 204 is laterally adjustable or repositionable while the one or more bearings remain laterally fixed or static relative to the axle 208 (e.g., remaining a fixed distance from the first and second limbs 202A, 202B).

Figure 2B:
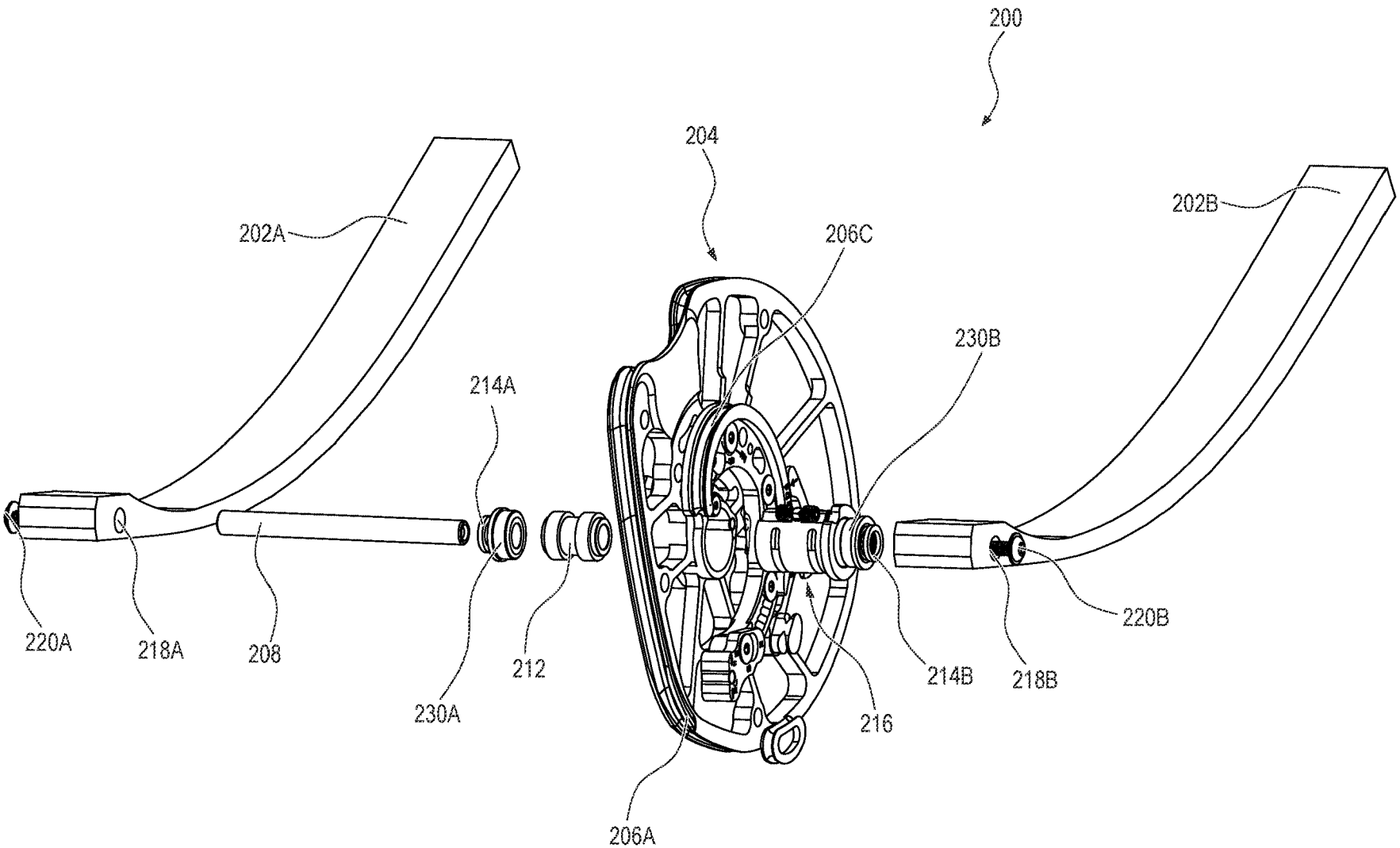
FIG. 2B is an exploded perspective side view of the cam assembly and limbs, according to some embodiments.

FIG. 2B shows an exploded view of the cam assembly 200, the first limb 202A, the second limb 202B, and an axle 208. The cam assembly 200 can include the rotatable member 204, a first bearing 230A, a second bearing 230B, a bearing spacer 212, a first cam spacer 214A, a second cam spacer 214B, and a bearing carriage assembly 216. In some examples, the rotatable member 204 can include one or more additional components associated with archery eccentrics, such as, modules, bolts, fasteners, dampers, pegs, pins, a combination thereof, or any other eccentric component. The axle 208 can extend through the cam assembly 200 and define an axis of rotation (see axis $A_3$ in FIG. 2F). The axle 208 can be retained within holes 218A, 218B in the first and second limbs 202A, 202B. For example, the axle 208 can be partially disposed within each hole 218A, 218B and threadably receive a fastener 220A, 220B to interlock the cam assembly 200, the first limb 202A, the second limb 202B, and the axle 208. Additionally, or alternatively, the axle 208 can be received within and supported by one or more limb hangers (see FIGS. 5A-5E). While the fasteners 220A, 220B are shown as bolts in FIGS. 2A-2B, the fasteners can be any fasteners, such as, bolts, set screws, snap rings, nuts, clips, pins, rivets, a combination thereof, or any other type of fastener.

Figure 2C:
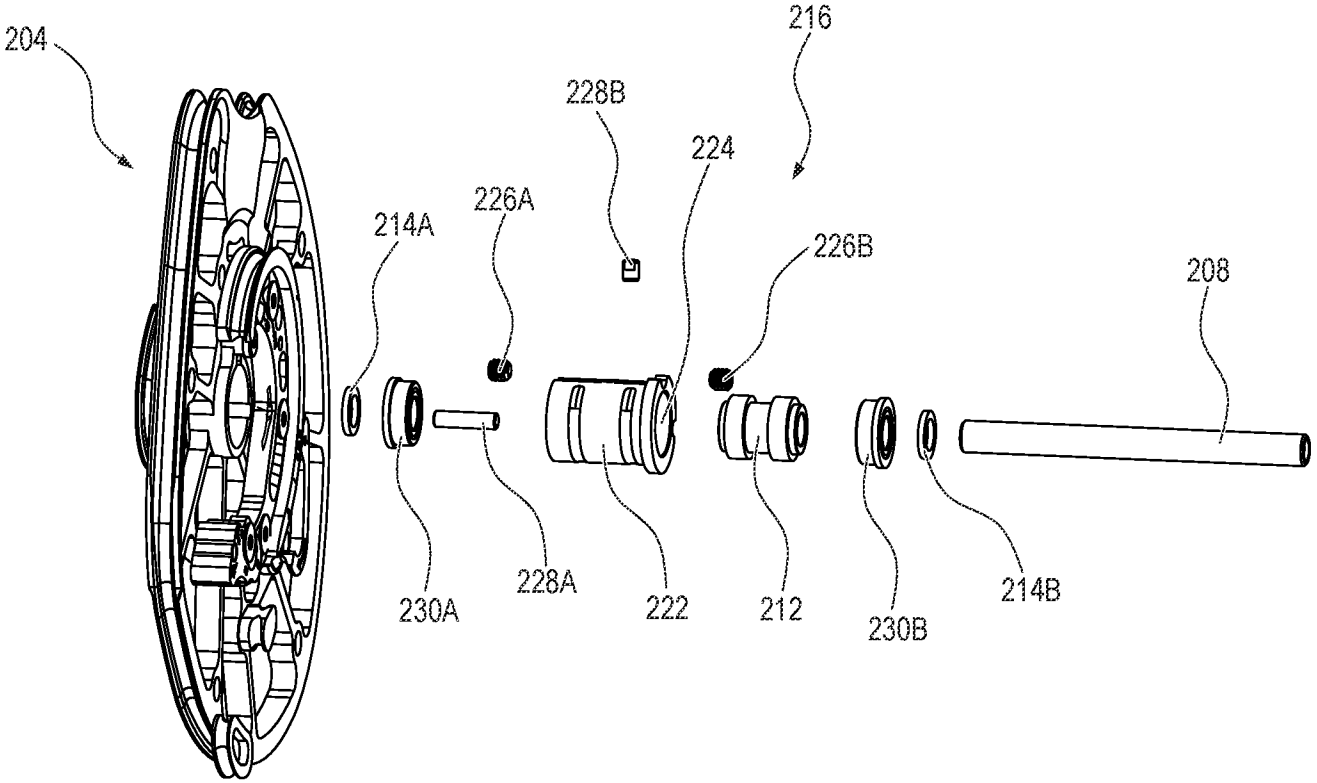
FIG. 2C is an exploded perspective side view of the cam assembly, according to some embodiments.

FIG. 2C shows an exploded view of the rotatable member 204, the axle 208, the first cam spacer 214A, the second cam spacer 214B, and the bearing carriage assembly 216. In some examples, the bearing carriage assembly 216 can include a bearing carriage 222 having a bore 224, one or more shared fasteners 226A, 226B, and one or more pins 228A, 228B. In some examples, the bearing carriage 222 can be cylindrical or otherwise have a circular cross-sectional shape. In other examples, the bearing carriage 222 can be cuboid or otherwise have a rectangular or square cross-sectional shape. The bearing carriage 222 can have any shape including cylindrical, cuboid, prismatic, hexagonal, spherical, hemispherical, a combination thereof, or any other three-dimensional shape.

In some examples, the one or more bearings 230A, 230B and the bearing spacer 212 can be at least partially disposed within the bore 224. For example, the one or more bearings 230A, 230B can be press-fit within the bore 224 and the bearing spacer 212 can be disposed between the bearings 230A, 230B within the bore 224. In some examples, the bearings 230A, 230B can be displaced from one another by a gap or distance (e.g., a width of the bearing spacer 212) and that gap or distance can be greater than or equal to 55% of a gap or distance between the first limb 202A and the second limb 202B (see gap G in FIG. 5E). In some examples, the gap or distance between the bearings 230A, 230B can be at least 13 mm, between about 13 mm and about 17 mm, between 17 mm and about 21 mm, between about 21 mm and about 25 mm, or greater than about 25 mm. In some examples, the gap or distance between the limbs 202A, 202B can be at least 23 mm, between about 23 mm and about 28 mm, between 28 mm and about 33 mm, between about 33 mm and about 38 mm, or greater than about 38 mm. The gap or distance between the bearings 230A, 230B can be greater than about 55%, between about 55% and about 65%, between 65% and about 75%, between about 75% and about 85%, or greater than about 85% of the gap or distance between the limbs 202A, 202B (see FIG. 5E).

In some examples, three or more bearings can be disposed within the bore 224 of the bearing carriage 222. One or more of the components of the bearing carriage assembly 216 can include or define concentric through-holes which allow the axle 208 to extend through the bearing carriage assembly 216. In some examples, the first cam spacer 214A can be disposed adjacent the first bearings 230A on the axle 208 when the cam assembly 200 is rotatably coupled to the limbs 202A, 202B. In some examples, the second cam spacer 214B can be disposed adjacent the second bearings 230B on the axle 208 when the cam assembly 200 is rotatably coupled to the limbs 202A, 202B.

Figure 2D:
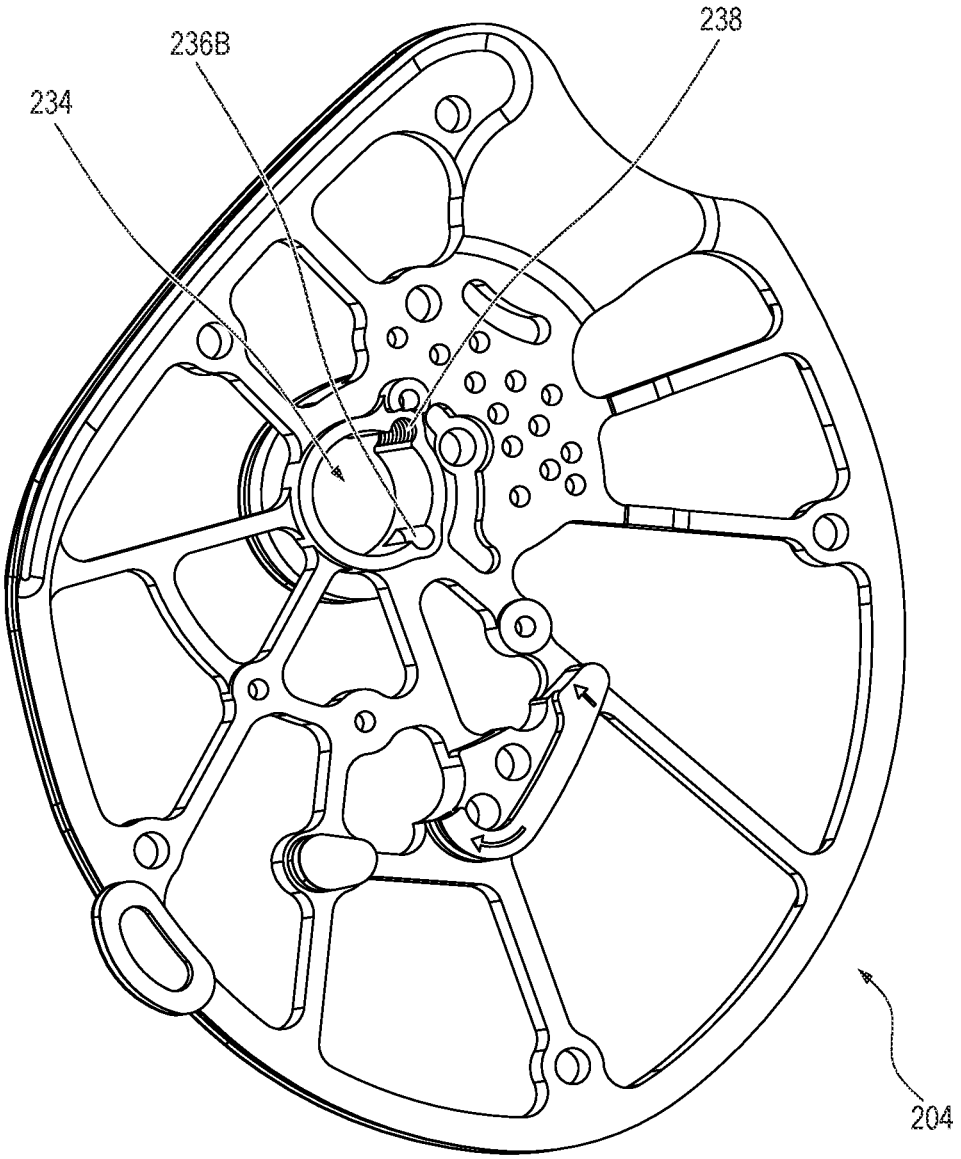
FIG. 2D is a perspective side view of a rotatable member, according to some embodiments.
Figure 2E:
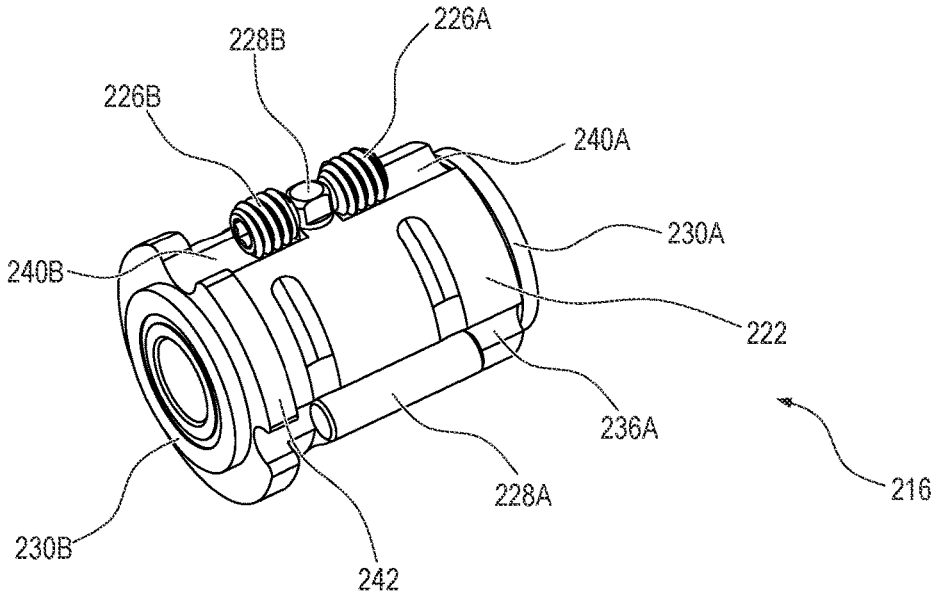
FIG. 2E is a detailed perspective side view of a bearing carriage assembly, according to some embodiments.
Figure 2F:
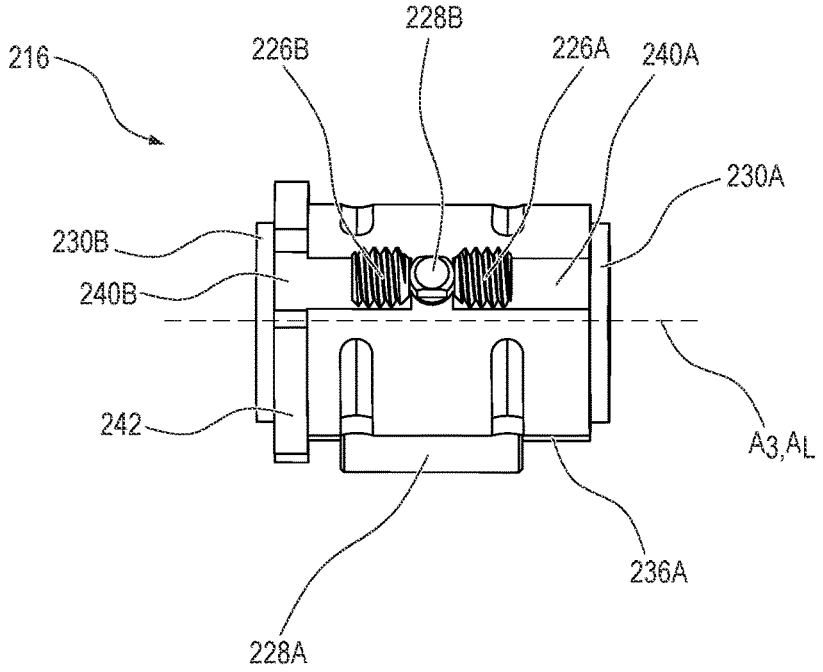
FIG. 2F is a detailed side view of the bearing carriage assembly, according to some embodiments.
Figure 2G:
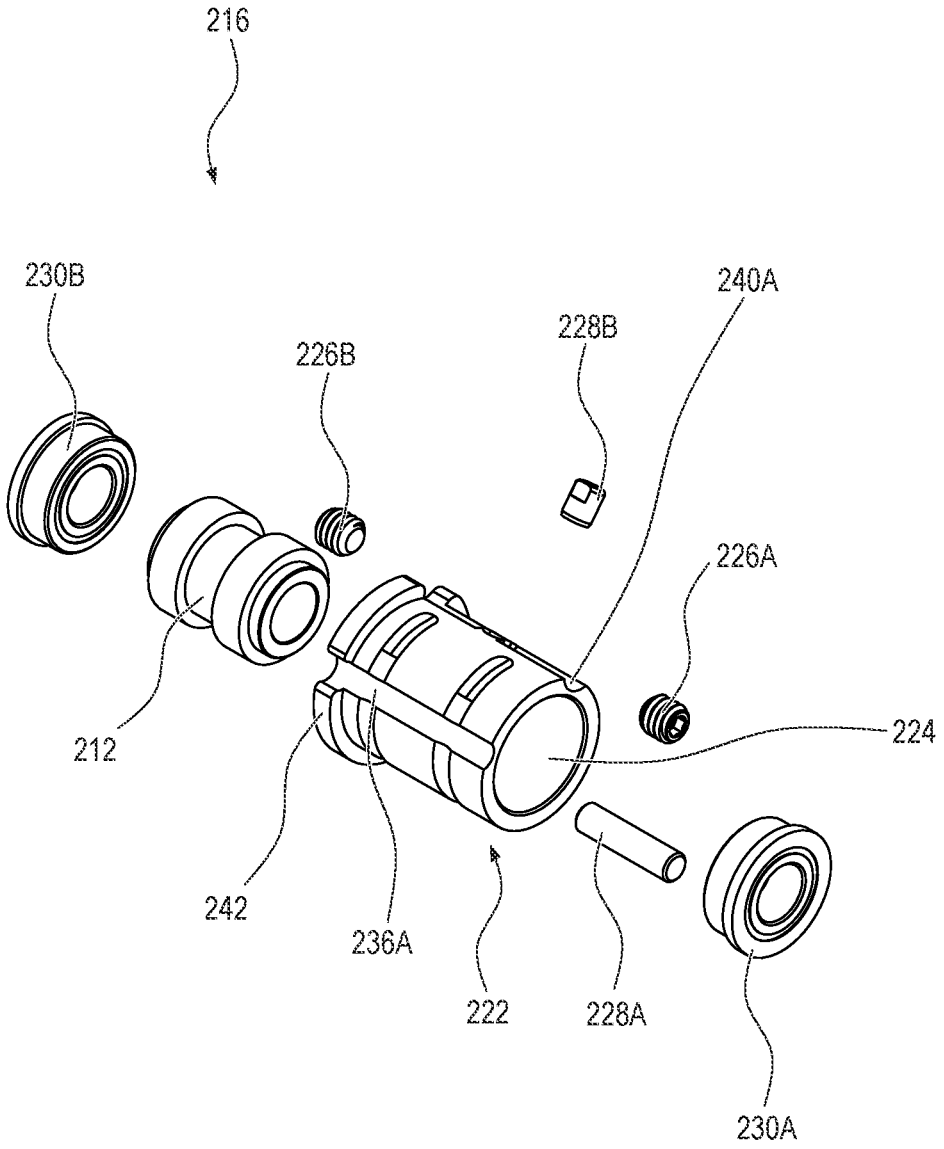
FIG. 2G is an exploded perspective side view of the bearing carriage assembly, according to some embodiments.

The bearing carriage 222 can be at least partially disposed within a bore 234 of the rotatable member 204 (see FIG. 2D). The bearing carriage 222 can be removable from the bore 234. In some examples, the one or more bearings 230A, 230B can remain disposed within the bearing carriage 222 when the bearing carriage 222 is removed from the bore 234. The bore 234 can have a cross-sectional shape that at least partially conforms to a cross-sectional shape of the bearing carriage 222 such that at least a portion of the bearing carriage 222 can be received by and disposed within the bore 234. The bore 234 can be a through-hole as depicted in FIG. 2D in some examples. In some examples, the bore 234 can be a blind-hole. In some examples, a periphery of the bore 234 (e.g., an inner surface of the rotatable member 204 that defines or forms the bore 234) can vary such that the bore 234 does not have a continuous cross-sectional shape along a width of the rotatable member 204. In some examples, at least a section of the bore 234 can be concentric or substantially concentric about an axis of rotation (see e.g., axes $A_1$, $A_2$, $A_3$) the rotatable member 204 rotates about. For example, between 50% and 90% of the inner surface of the rotatable member 204 that defines the bore 234 can have a constant radius relative to the axis of rotation. The other portions of the inner surface of the rotatable member 204 that define the bore 234 that do not have a constant radius can form features such as splines, keyways, blind-holes, through-holes, threaded apertures, chamfers, bevels, combinations thereof, or any other feature.

In some examples, one or more fasteners can be disposed between the bearing carriage 222 and the bore 234 of the rotatable member 204. For example, the first pin 228A can be at least partially disposed within a first channel 236A defined or formed by the bearing carriage 222 and also partially disposed within a second channel 236B defined or formed within the bore 234 of the rotatable member 204 (see FIGS. 2E-2H). The first pin 228A can engage the first channel 236A, the second channel 236B, or a combination of the first and second channel 236A, 236B to clock or orient the bearing carriage 222 relative to the rotatable member 204. Additionally, or alternatively, the first pin 228A can engage the first channel 236A, the second channel 236B, or a combination of the first and second channel 236A, 236B to limit or prevent the bearing carriage 222 from rotating within the bore 234 while the cam assembly 200 rotates when an arrow is launched from the archery bow. In some examples, the rotatable member 204 can laterally slide or translate relative to the bearing carriage 222 and the first pin 228A can act as a rail or track guiding translation of the rotatable member 204 relative to the bearing carriage 222. While FIGS. 2A-2J depict only the first pin 228A and corresponding channels 236A, 236B, the rotatable member 204 and the bearing carriage assembly 216 can accommodate a plurality of pins receivable within respective channels positioned within the bore 234.

In some examples, the first channel 236A constitutes a first engagement feature defined on a portion of the exterior surface of the bearing carriage 222. The second channel 236B can define a second engagement feature on a portion of the interior surface of the rotatable member 204. The first pin 228A can contact or interface the first engagement feature and the second engagement feature.

Figure 2H:
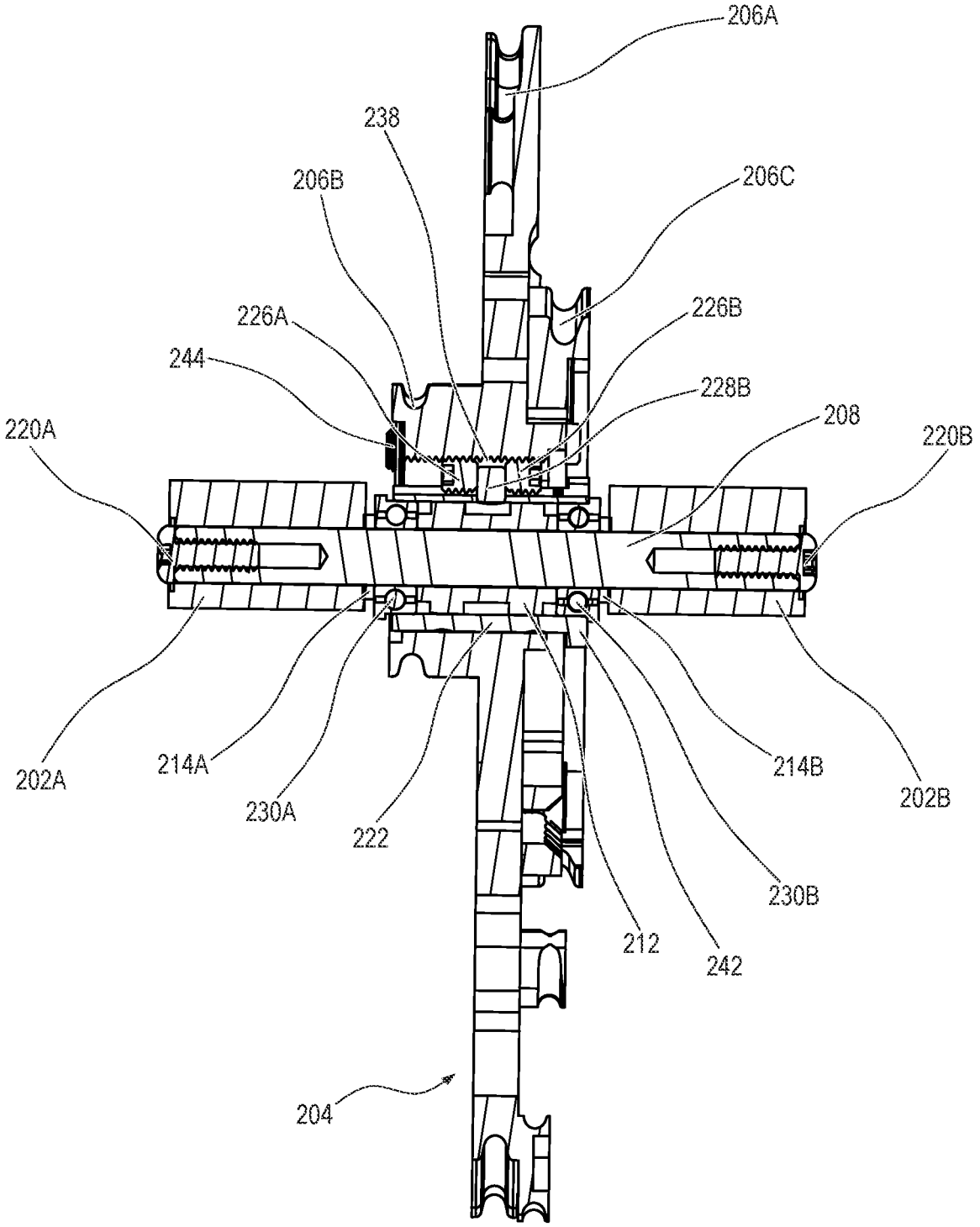
FIG. 2H is a cross-sectional rear view of the lower portion of the cam assembly and limbs, according to some embodiments.

In some examples, the bore 234 can include one or more features for receiving a fastener. For example, the bore 234 can include one or more threaded channels 238 for receiving the one or more shared fasteners 226A, 226B (see FIGS. 2E-2H). FIG. 2H shows a cross-sectional rear view of the cam assembly 200, the first limb 202A, the second limb 202B, and the axle 208 through a section line positioned similar to the section line SL-SL shown in FIG. 1A (e.g., a section taken of the lower cam assembly through the axis of rotation $A_2$ and parallel to the length of the bowstring 120 extending between the top and bottom cam assemblies 116, 118). In some examples, the shared fasteners 226A, 226B can be set screws or other fasteners which are disposed between the bearing carriage 222 and the bore 234 (i.e., the shared fasteners 226A, 226B can engage both the rotatable member 204 and the bearing carriage 222, hence "shared"). The one or more shared fasteners 226A, 226B can engage the threaded channel 238 to facilitate lateral translation of the rotatable member 204 relative to the bearing carriage 222. In some examples, the one or more shared fasteners 226A, 226B can be at least partially disposed within one or more channels 240A, 240B formed or defined on the bearing carriage 222. For example, while the bearing carriage 222 is at least partially disposed within the bore 234, the one or more shared fasteners 226A, 226B can be inserted into, removed from, or rotated within respective apertures formed or defined by the threaded channel 238 and the one or more channels 240A, 240B.

In some examples, the one or more channels 240A, 240B constitute a first engagement feature defined on a portion of the exterior surface of the bearing carriage 222. The threaded channel 238 can define a second engagement feature on a portion of the interior surface of the rotatable member 204. The one or more shared fasteners 226A, 226B can contact or interface the first engagement feature and the second engagement feature.

When rotated, the one or more shared fasteners 226A, 226B can threadably engage the threaded channel 238 to cause the rotatable member 204 to laterally translate to one of a plurality of positions relative to the bearing carriage 222. The plurality of positions can extend parallel to and along the axis of rotation (e.g., axis of rotation $A_2$). For example, counter-clockwise rotation of the second shared fastener 226B may retract or withdraw the second shared fastener 226B along the threaded channel 238. This rotation may form a gap or a space between the second shared fastener 226B and the second pin 228B. Clockwise rotation of the first shared fastener 226A can drive or move the first shared fastener 226A deeper along the threaded channel 238 causing the rotatable member 204 to laterally translate and close or remove the gap or space. In this manner, the rotatable member 204 can be translated or shifted relative to the bearing carriage 222 to modify or vary a position of the rotatable member 204 relative to the limbs 202A, 202B without modifying or varying a position of the bearing carriage 222 or bearings 230A, 230B relative to the limbs 202A, 202B. As the bearings 230A, 230B are disposed within the bearing carriage 222, the rotatable member 204 translates or shifts relative to the bearings 230A, 230B as well. Varying a position of the rotatable member 204 relative to the bearing carriage 222 and the bearings 230A, 230B will be described in addition detail herein with reference to FIGS. 2I-2J. While the rotatable member 204 has been described as laterally translating relative to the bearing carriage assembly 216, it should be appreciated that the rotatable member 204 and the bearing carriage assembly 216 can additionally, or alternatively, move or translate rotationally about the axle 208. For example, the bearing carriage assembly 216 is rotationally interlocked to the rotatable member 204 via one or both of the first and second pins 228A, 228B such that the two components rotate in unison about the axle 208 as a singular entity when the archery bow is used to launch arrows.

The second pin 228B can be pressed, coupled, or integrally formed within or between the channels 240A, 240B to act as a protrusion or feature the first and second threaded fasteners 226A, 226B can engage to facilitate translation of the rotatable member 204 relative to the bearing carriage 222. While shown as a pin, the second pin 228B can be any fastener or feature affixed or formed on the bearing carriage 222. In some examples, the second pin 228B can extend into the bore 224 of the bearing carriage 222 and engage the bearing spacer 212.

In some examples, the bearing carriage 222 can include a flange or lateral rim 242 protruding or extending perpendicular to a longitudinal axis $A_L$ of the bearing carriage 222. The lateral rim 242 can act as a stop or an obstruction for limiting lateral translation of the rotatable member 204 along the axis $A_3$ beyond a desired position relative to the bearing carriage 222. For example, the lateral rim 242 can abut or contact a portion of the rotatable member 204 adjacent the bore 234 to limit or prevent the rotatable member 204 from translating along the axis $A_3$ in the lateral right direction $L_R$ (see FIGS. 2H and 2J)) beyond an edge or lateral side of the bearing carriage 222.

In some examples, the bearing carriage assembly 216 can include a fastener 244 limiting or preventing the rotatable member 204 from translating along the axis $A_3$ beyond an edge or lateral side of the bearing carriage 222 opposite the lateral rim 242. For example, a head of the fastener 244 (see FIG. 2H) can extend over the aperture formed by the channel 240A and the threaded channel 238 as to limit or prevent the first shared fastener 226A from being rotated and removed from the aperture. Preventing removal of the first shared fastener 226A from the channel 240A can limit lateral translation of the rotatable member 204 relative to the bearing carriage 222 in the lateral left direction $L_L$ (see FIG. 2I) by acting as a stop or obstruction. In other words, the head of the fastener 244 can act as a stop for the first shared fastener 226A in a left-most position and the second pin 228B can contact the first shared fastener 226A in the left-most position to prevent further lateral translation of the rotatable member 204.

Figure 2I:
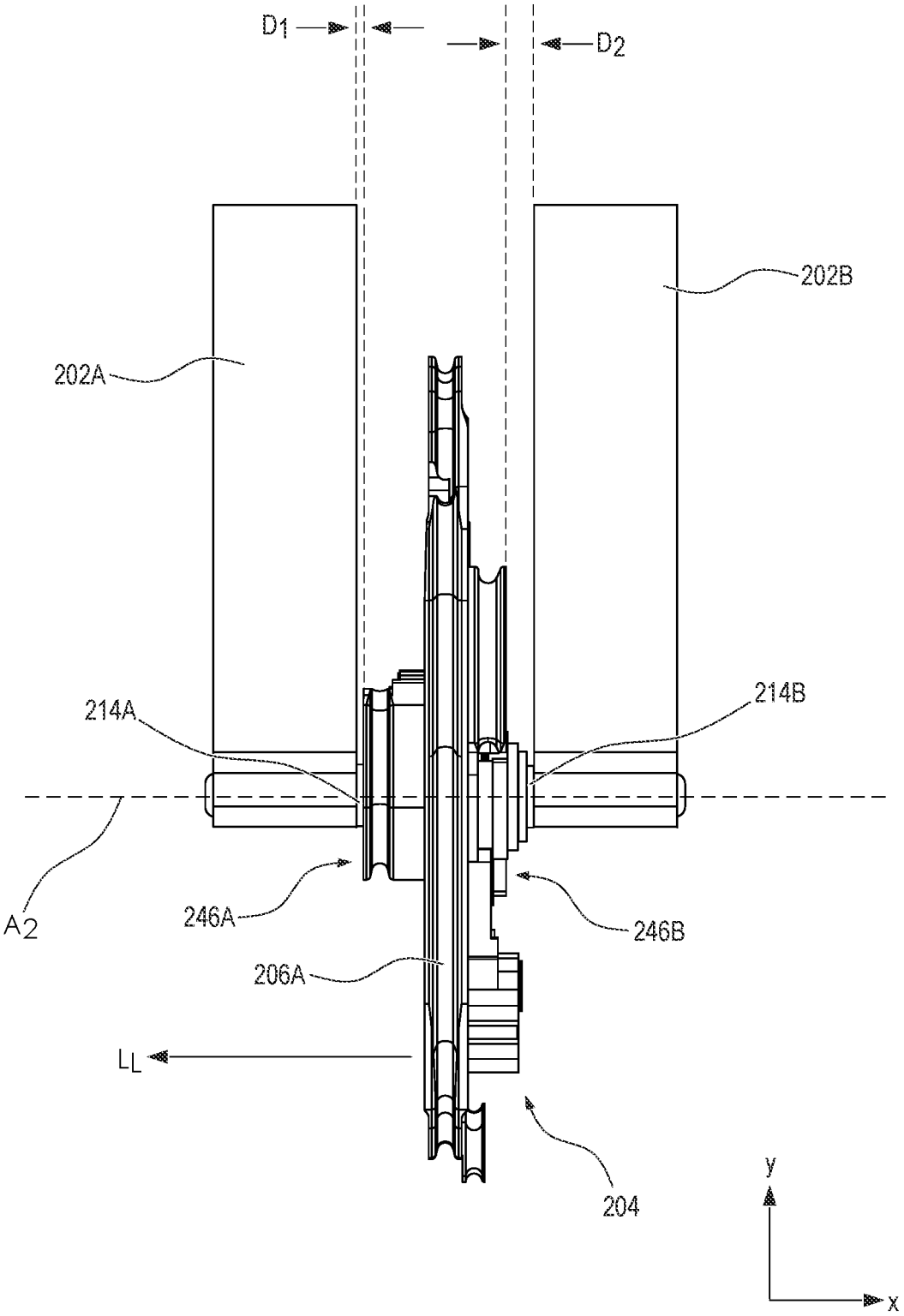
FIG. 2I is a rear view of the cam assembly coupled to the limbs in a first configuration, according to some embodiments.

FIG. 2I shows the rotatable member 204 in a first configuration relative to the bearing carriage assembly 216. The first configuration can correlate to a first position of a plurality of positions of the rotatable member 204 relative to the bearing carriage 222, the one or more bearings 230A, 230B, the first limb 202A, the second limb 202B, or a combination thereof. In other words, the position of the rotatable member 204 is laterally varied along, and extending parallel to, the axis of rotation $A_2$ while the bearing carriage assembly 216, the one or more bearings 230A, 230B, the first limb 202A, the second limb 202B, and the axle 208 all remain substantially laterally unmoved or unchanged along the axis of rotation $A_2$. By varying the lateral position of the rotatable member 204 an extent to which the rotatable member 204 leans or cants can be varied to impact or influence shooting characteristics of the archery bow. For example, the bowstring plane P (see FIG. 1B) can be altered or varied to beneficially affect the orientation (e.g., yaw and roll) of the rotatable member 204 while the arrow decouples from the bowstring. Altering or varying the yaw and/or roll of the rotatable member 204 can vary the loading path exerted on the arrow by the bowstring. In some examples, the rotatable member 204 can be laterally translated or laterally repositioned in the lateral left direction (as designated by the arrow $L_L$) such that the bowstring groove 206A is shifted or moved toward the first limb 202A and away from the second limb 202B. Shifting or repositioning the rotatable member 204 relatively closer to the first limb 202A can alter or vary a moment induced on the cam assembly 200 and therefore alter or vary a lean or camber of the cam assembly 200.

In the first position or first configuration, a first lateral side 246A of the rotatable member 204 is disposed a first distance $D_1$ from the first limb 202A while a second lateral side 246B of the rotatable member 204 is disposed a second distance $D_2$ from the second limb 202B. In some examples, the first distance $D_1$ can be less than the second distance $D_2$. In some examples, the first distance $D_1$ can be equivalent or substantially equivalent to the second distance $D_2$. The first distance $D_1$ can be less than about 1 mm, between about 1 mm and about 3 mm, between about 3 mm and about 5 mm, between about 5 mm and about 8 mm, or greater than about 8 mm. The second distance $D_2$ can be less than about 2 mm, between about 2 mm and about 4 mm, between about 4 mm and about 7 mm, between about 7 mm and about 10 mm, or greater than about 10 mm. The first lateral side 246A of the rotatable member 204 can be any lateral-facing surface of the rotatable member 204 facing the lateral left direction $L_L$, such as, a lateral or sideward facing surface of the rotatable member 204, a module, a fastener, a bearing, a pin, a damper, or any other cam component that may be affixed to the rotatable member 204. Similarly, the second lateral side 246B of the rotatable member 204 can be any lateral-facing surface of the rotatable member 204 facing the lateral right direction $L_R$, such as, a lateral or sideward facing surface of the rotatable member 204, a module, a fastener, a bearing, a pin, a damper, or any other cam component that may be affixed to the rotatable member 204.

Figure 2J:
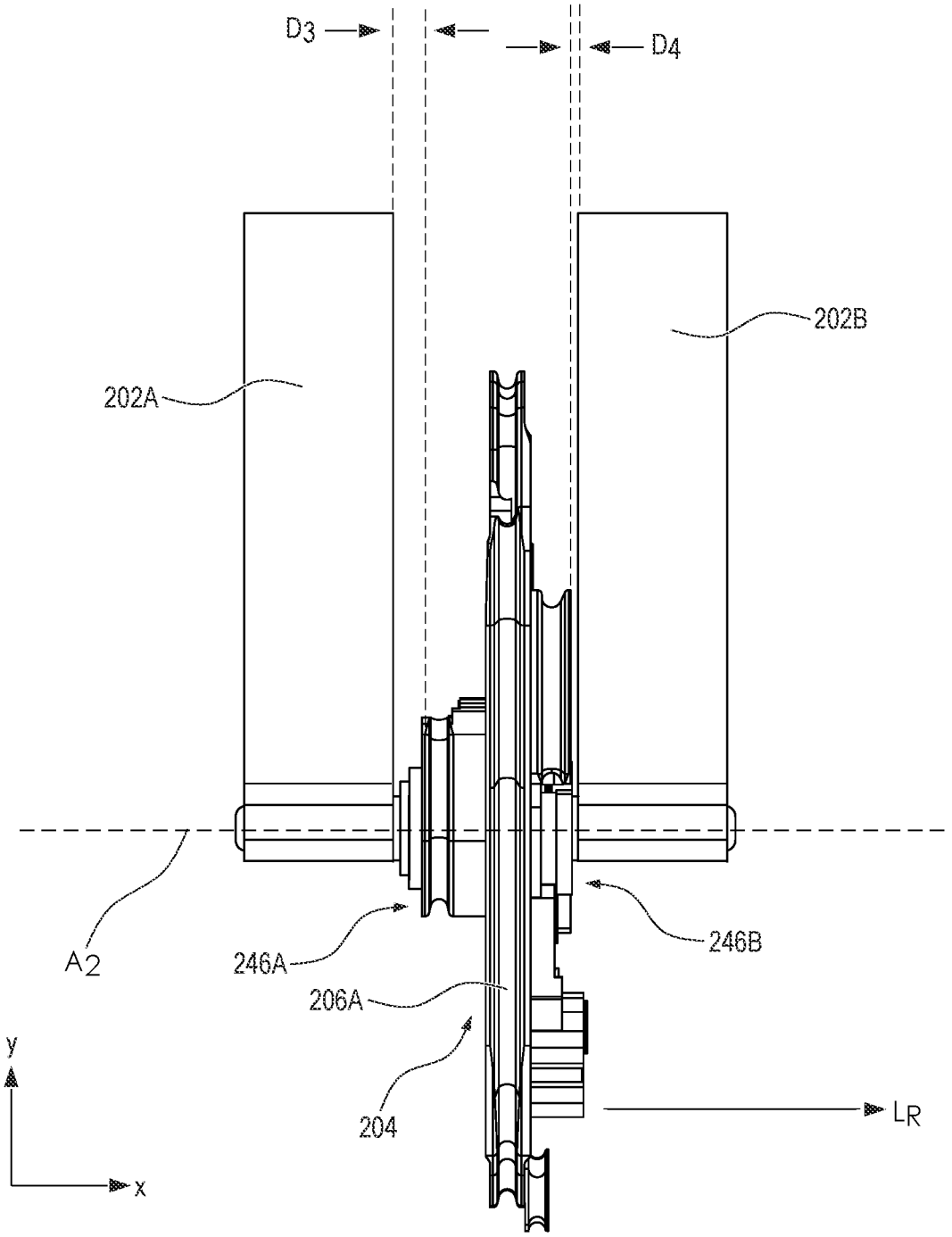
FIG. 2J is a rear view of the cam assembly coupled to the limbs in a second configuration, according to some embodiments.

FIG. 2J shows the rotatable member 204 in a second configuration relative to the bearing carriage assembly 216. The second configuration can correlate to a second position of a plurality of positions of the rotatable member 204 relative to the bearing carriage 222, the one or more bearings 230A, 230B, the first limb 202A, the second limb 202B, or a combination thereof. In other words, the position of the rotatable member 204 is laterally varied along the axis of rotation $A_2$ while the bearing carriage assembly 216, the one or more bearings 230A, 230B, the first limb 202A, the second limb 202B, and/or the axle 208 all remain substantially laterally fixed along the axis of rotation $A_2$. By varying the lateral position of the rotatable member 204 an extent to which the rotatable member 204 leans or cants can be varied to impact or influence shooting characteristics of the archery bow. For example, the bowstring plane P (see FIG. 1B) can be altered or varied to beneficially affect the orientation (e.g., yaw and roll) of the rotatable member 204 while the arrow decouples from the bowstring. Altering or varying the yaw and/or roll of the rotatable member 204 can vary the loading path exerted on the arrow by the bowstring. In some examples, the rotatable member 204 can be laterally translated or laterally repositioned in the lateral right direction (as designated by the arrow $L_R$) such that the bowstring groove 206A is shifted or moved toward the second limb 202B and away from the first limb 202A. Shifting or repositioning the rotatable member 204 relatively closer to the second limb 202B can alter or vary a moment induced on the cam assembly 200 and therefore alter or vary a lean or camber of the cam assembly 200.

In the second position or second configuration, the first lateral side 246A of the rotatable member 204 is disposed a third distance $D_3$ from the first limb 202A while the second lateral side 246B of the rotatable member 204 is disposed a fourth distance $D_4$ from the second limb 202B. In some examples, the third distance $D_3$ can be greater than the fourth distance $D_4$. In some examples, the first distance $D_1$ can be less than the third distance $D_3$. In some examples, the fourth distance $D_4$ can be less than the second distance $D_2$. Meanwhile, the one or more bearings 230A, 230B can remain a fixed distance relative to the limbs 202A, 202B (e.g., a distance between the bearing and a respective limb remains unchanged regardless of the configuration of the rotatable member).

In some examples, the third distance $D_3$ can be equivalent or substantially equivalent to the fourth distance $D_4$. The third distance $D_3$ can be less than about 2 mm, between about 2 mm and about 4 mm, between about 4 mm and about 7 mm, between about 7 mm and about 10 mm, or greater than about 10 mm. The fourth distance $D_4$ can be less than about 1 mm, between about 1 mm and about 3 mm, between about 3 mm and about 5 mm, between about 5 mm and about 8 mm, or greater than about 8 mm.

While the rotatable member 204 is shown in only two positions or configurations, in some examples, the two positions or configurations shown in FIGS. 2I and 2J can represent lateral limits to a range of adjustment the rotatable member 204 is capable of undertaking. For example, the first configuration shown in FIG. 2I can be a maximum left-most position of the rotatable member 204 and the rotatable member 204 can be repositioned or shifted to the right through a plurality of positions until the rotatable member 204 reaches the second configuration shown in FIG. 2J (e.g., a maximum right-most position of the rotatable member 204). In other words, the rotatable member 204 can be disposed at any one of a spectrum of positions extending between the first configuration (FIG. 2I) and the second configuration (FIG. 2J). In some examples, the threaded nature of the engagement formed or defined by the threaded channel 238 and the shared fasteners 226A, 226B can facilitate hundreds of positions for the rotatable member 204 relative to the bearing carriage 222 by incremental rotation of the shared fasteners 226A, 226B. In some examples, therefore, the plurality of positions may include a spectrum of positions rather than a set of discrete positions independent from one another.

In some examples, a total range of adjustment of the rotatable member 204 (e.g., a total travel distance from the left-most position to right-most position) can be less than about 2 mm, between about 2 mm and about 4 mm, between about 4 mm and about 6 mm, between about 6 mm and about 8 mm, or greater than about 8 mm. In some examples, the total range of adjustment of the rotatable member 204 can be equal to or less than a total thickness of the one or more cam spacers 214A, 214B (i.e., a total spacer thickness). For example, each of the first and second cam spacers 214A, 214B can have a respective thickness and the total range of adjustment of the rotatable member 204 (i.e., a total translation range) can be less than or equal to the combined respective thicknesses of the first and second cam spacers 214A, 214B. In some examples, the total spacer thickness of the one or more cam spacers 214A, 214B can be less than about 2 millimeters (mm), between about 2 mm and about 4 mm, between about 4 mm and about 6 mm, between about 6 mm and about 8 mm, or greater than about 8 mm. In other examples, the total range of adjustment can be less than or equal to a gap between the first and second limbs 202A, 202B (see gap G in FIG. 5E).

Figure 3A:
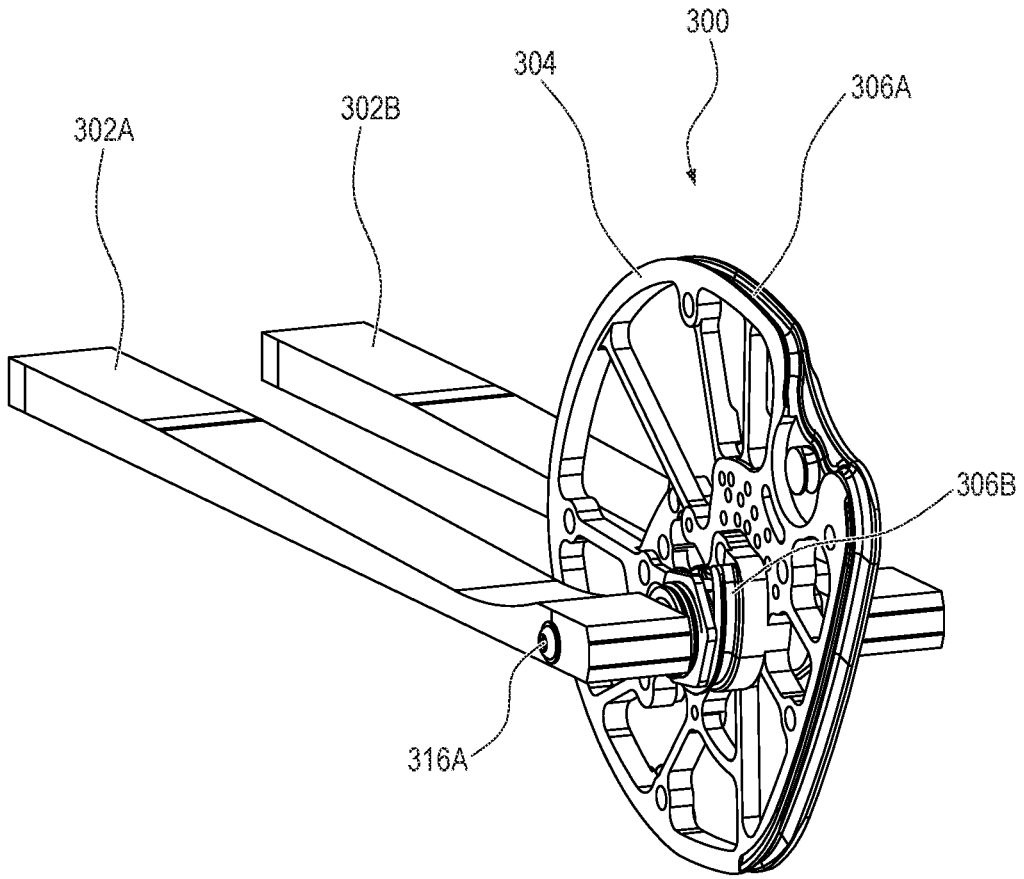
FIG. 3A is a perspective side view of a cam assembly and limbs, according to some embodiments.

FIG. 3A shows a rear view of a cam assembly 300 rotatably coupled to a first limb 302A and a second limb 302B. The cam assembly 300 can be similar to, and can include some or all of the features of, the cam assemblies 116, 118, 200. For example, the cam assembly 300 can include a rotatable member 304 at least partially defining a bowstring plane P (see FIG. 2A). The rotatable member 304 can include a bowstring groove 306A and one or more cable grooves 306B. The bowstring plane P can be at least partially disposed within the bowstring groove 306A. The rotatable member 304 can be repositionable relative to one or more bearings (see FIGS. 3B and 3C) of the cam assembly 300 such that the rotatable member 304 is laterally adjustable or repositionable while the one or more bearings remain laterally fixed or static relative to the axle 308 (e.g., remaining a fixed distance from the first and second limbs 302A, 302B).

Figure 3B:
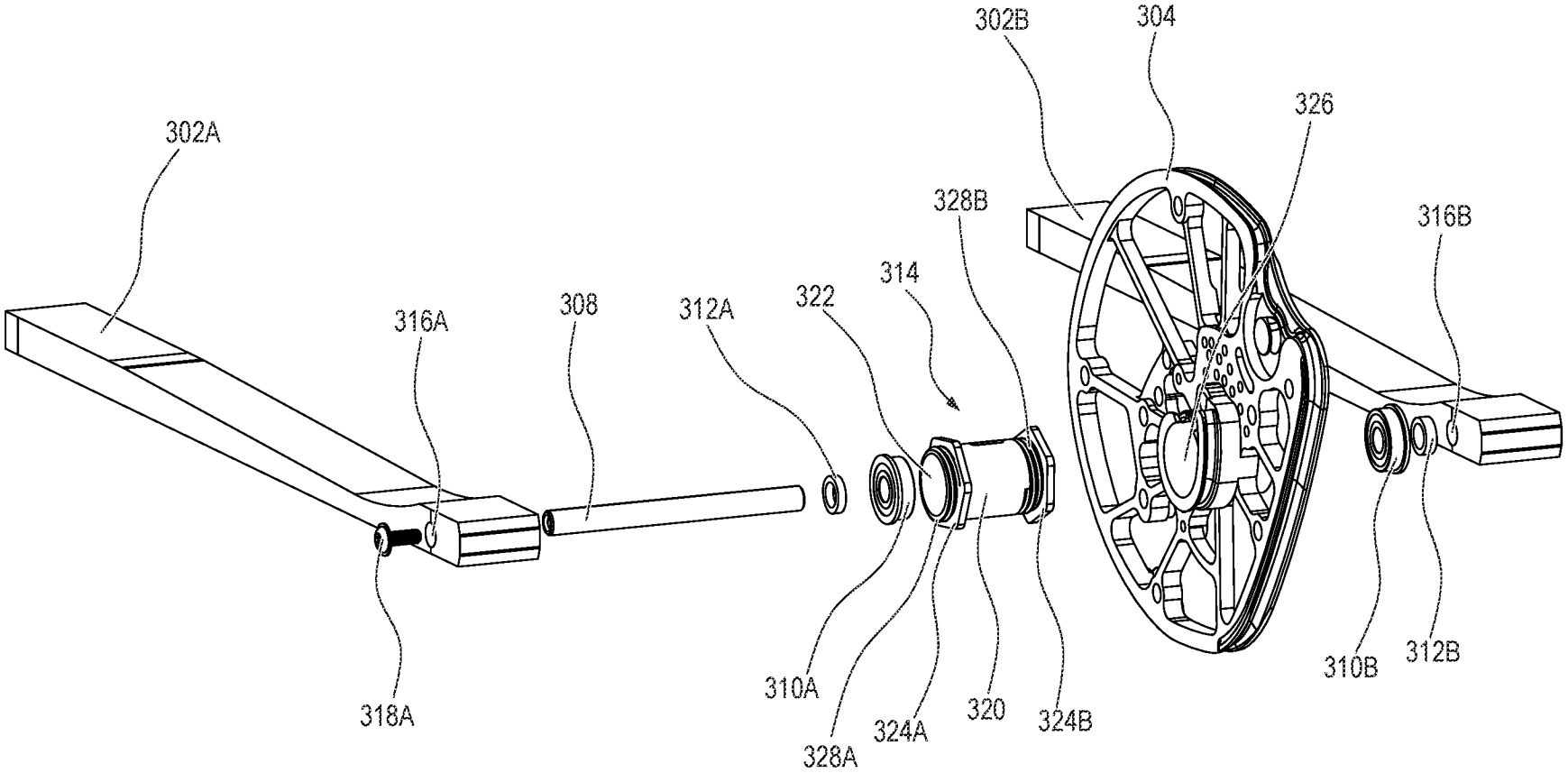
FIG. 3B is an exploded perspective side view of the cam assembly and the limbs, according to some embodiments.
Figure 3C:
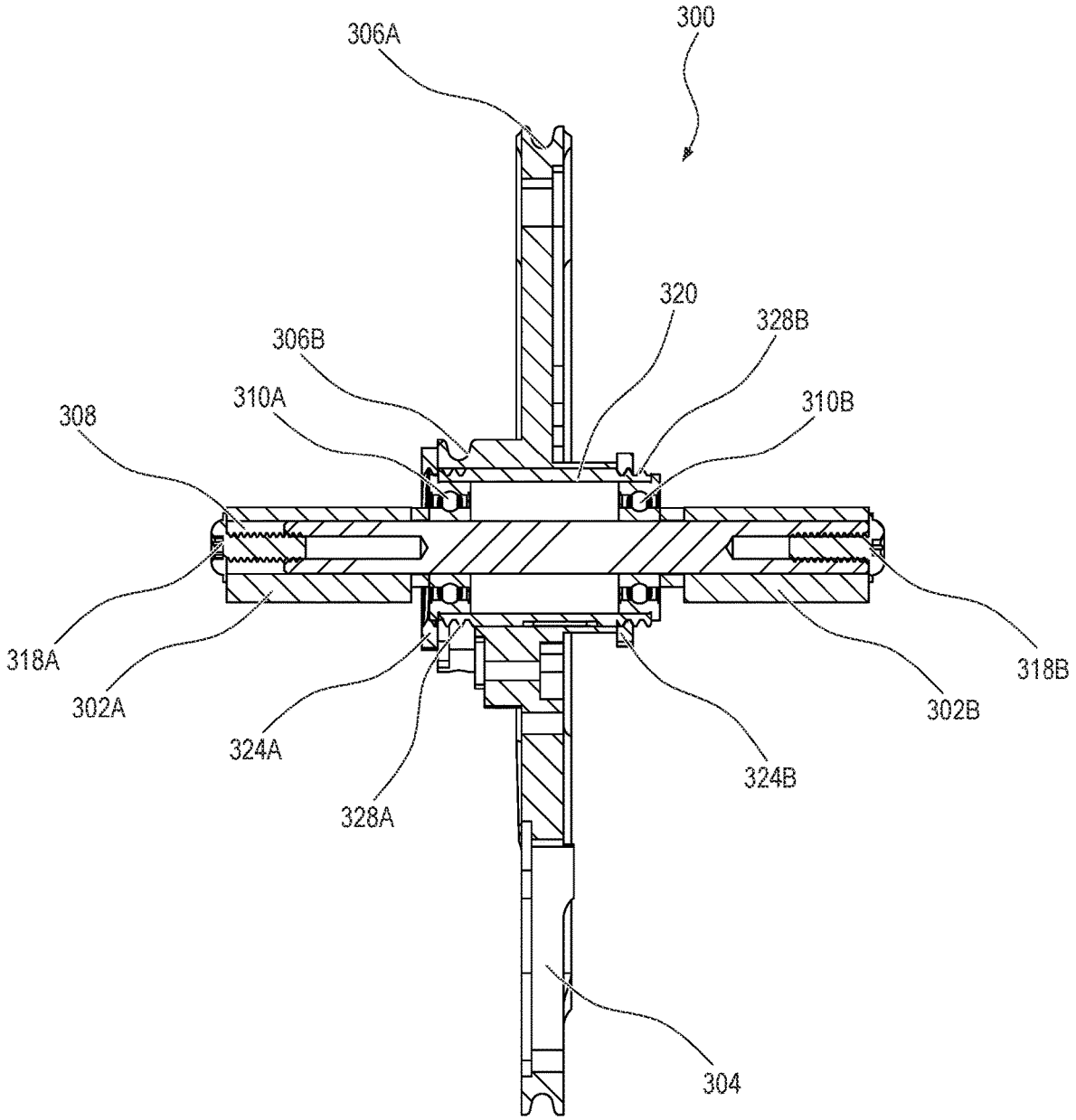
FIG. 3C is a cross-sectional rear view of the cam assembly and limbs, according to some embodiments.

FIG. 3B shows an exploded view of the cam assembly 300, the first limb 302A, the second limb 302B, and an axle 308. FIG. 3C shows a cross-sectional rear view of the cam assembly 300, the first limb 302A, the second limb 302B, and the axle 308 through a section line positioned similar to the section line SL-SL shown in FIG. 1A (e.g., a section taken of the lower cam assembly through the axis of rotation $A_2$ and parallel to the length of the bowstring 120 extending between the top and bottom cam assemblies 116, 118). The cam assembly 300 can include the rotatable member 304, a first bearing 310A, a second bearing 310B, a first cam spacer 312A, a second cam spacer 312B, and a bearing carriage assembly 314. In some examples, the rotatable member 304 can include one or more additional components associated with archery eccentrics, such as, modules, bolts, fasteners, dampers, pegs, pins, a combination thereof, or any other eccentric component. The axle 308 can extend through the cam assembly 300 and define an axis of rotation. The axle 308 can be retained within holes 316A, 316B in the first and second limbs 302A, 302B. For example, the axle 308 can be partially disposed within each hole 316A, 316B and threadably receive a fastener 318A, 318B to interlock the cam assembly 300, the first limb 302A, the second limb 302B, and the axle 308. Additionally, or alternatively, the axle 308 can be received within and supported by one or more limb hangers (see FIGS. 5A-5E). While the fasteners 318A, 318B are shown as bolts in FIGS. 3A-3E, the fasteners can be any fasteners, such as, bolts, set screws, snap rings, nuts, clips, pins, rivets, a combination thereof, or any other type of fastener.

In some examples, the bearing carriage assembly 314 can include a bearing carriage 320 having a bore 322, and one or more fasteners 324A, 324B. In some examples, the bearing carriage 320 can be cylindrical or otherwise have a circular cross-sectional shape. In other examples, the bearing carriage can be cuboid or otherwise have a rectangular or square cross-sectional shape. The bearing carriage 320 can have any shape including cylindrical, cuboid, prismatic, hexagonal, spherical, hemispherical, a combination thereof, or any other three-dimensional shape.

In some examples, the one or more bearings 310A, 310B can be at least partially disposed within the bore 322. For example, the one or more bearings 310A, 310B can be press-fit within the bore 322. In some examples, three or more bearings can be disposed within the bore 322 of the bearing carriage 320. In some examples, the bearings 310A, 310B can be displaced from one another by a gap or distance and that gap or distance can be greater than or equal to 55% of a gap or distance between the first limb 302A and the second limb 302B (see gap G in FIG. 5E). In some examples, the gap or distance between the bearings 310A, 310B can be at least 13 mm, between about 13 mm and about 17 mm, between 17 mm and about 21 mm, between about 21 mm and about 25 mm, or greater than about 25 mm. In some examples, the gap or distance between the limbs 302A, 302B can be at least 23 mm, between about 23 mm and about 28 mm, between 28 mm and about 33 mm, between about 33 mm and about 38 mm, or greater than about 38 mm. The gap or distance between the bearings 310A, 310B can be greater than about 55%, between about 55% and about 65%, between 65% and about 75%, between about 75% and about 85%, or greater than about 85% of the gap or distance between the limbs 302A, 302B (see FIG. 5E).

One or more of the components of the bearing carriage assembly 314 can include or define concentric through-holes which allow the axle 308 to extend through the bearing carriage assembly 314. In some examples, the first cam spacer 312A can be disposed adjacent the first bearings 310A on the axle 308 when the cam assembly 300 is rotatably coupled to the limbs 302A, 302B. In some examples, the second cam spacer 312B can be disposed adjacent the second bearings 310B on the axle 308 when the cam assembly 300 is rotatably coupled to the limbs 302A, 302B.

The bearing carriage 320 can be at least partially disposed within a bore 326 of the rotatable member 304 (see FIG. 3B). The bearing carriage 320 can be removable from the bore 326. In some examples, the one or more bearings 310A, 310B can remain disposed within the bearing carriage 320 when the bearing carriage 320 is removed from the bore 326. The bore 326 can have a cross-sectional shape that at least partially conforms to a cross-sectional shape of the bearing carriage 320 such that at least a portion of the bearing carriage 320 can be received by and disposed within the bore 326. The bore 326 can be a through-hole as depicted in FIG. 3B in some examples. In some examples, the bore 326 can be a blind-hole. In some examples, a periphery of the bore 326 (e.g., an inner surface of the rotatable member 304 that defines or forms the bore 326) can vary such that the bore 326 does not have a continuous cross-sectional shape along a width of the rotatable member 304. In some examples, at least a section of the bore 326 can be concentric or substantially concentric about an axis of rotation (see e.g., axes $A_1$, $A_2$, $A_3$) the rotatable member 304 rotates about. For example, between 50% and 90% of the inner surface of the rotatable member 304 that defines the bore 326 can have a constant radius relative to the axis of rotation. The other portions of the inner surface of the rotatable member 304 that define the bore 326 that do not have a constant radius can form features such as splines, keyways, blind-holes, through-holes, threaded apertures, chamfers, bevels, combinations thereof, or any other feature.

In some examples, the bearing carriage 320 can include one or more threaded portions 328A, 328B formed, for example, on lateral ends of the bearing carriage 320 to engage the one or more fasteners 324A, 324B. In some examples, the threaded portions 328A, 328B can extend an entire width of the bearing carriage 320. In some examples, the one or more fasteners 324A, 324B can be nuts, such as, hex nuts, lock nuts, jam nuts, square nuts, flange nuts, a combination thereof, or any other type of nut. When rotated, the one or more fasteners 324A, 324B can cause the rotatable member 304 to translate or move to one of a plurality of positions relative to the bearing carriage 320 and the one or more bearings 310A, 310B. For example, counter-clockwise rotation of the second fastener 324B may retract or withdraw the second fastener 324B from contacting the rotatable member 304. This rotation may form a gap or a space between the second fastener 324B and the rotatable member 304. Clockwise rotation of the first fastener 324A can drive or laterally move the rotatable member 304 to close or remove the gap or space (i.e., engage the rotatable member 304 to lock the rotatable member 304 in a fixed lateral position). In this manner, the rotatable member 304 can be translated or shifted relative to the bearing carriage 320 to modify or vary a position of the rotatable member 304 relative to the limbs 302A, 302B without modifying or varying a position of the bearing carriage 320 or bearings 310A, 310B relative to the limbs 302A, 302B. In some examples, the one or more fasteners 324A, 324B can act as jam nuts which engage the rotatable member 304 to prevent lateral movement of the rotatable member 304 relative to the bearing carriage 320.

Varying a position of the rotatable member 304 relative to the bearing carriage 320 and the bearings 310A, 310B will be described in addition detail herein with reference to FIGS. 3D and 3E. While the rotatable member 304 has been described as laterally translating relative to the bearing carriage assembly 314, it should be appreciated that the rotatable member 304 and the bearing carriage assembly 314 can additionally, or alternatively, move or translate rotationally about the axle 308. For example, the bearing carriage assembly 314 can be rotationally interlocked to the rotatable member 304 such that the two components rotate in unison about the axle 308 as a singular entity when the archery bow launches a projectile.

Figure 3D:
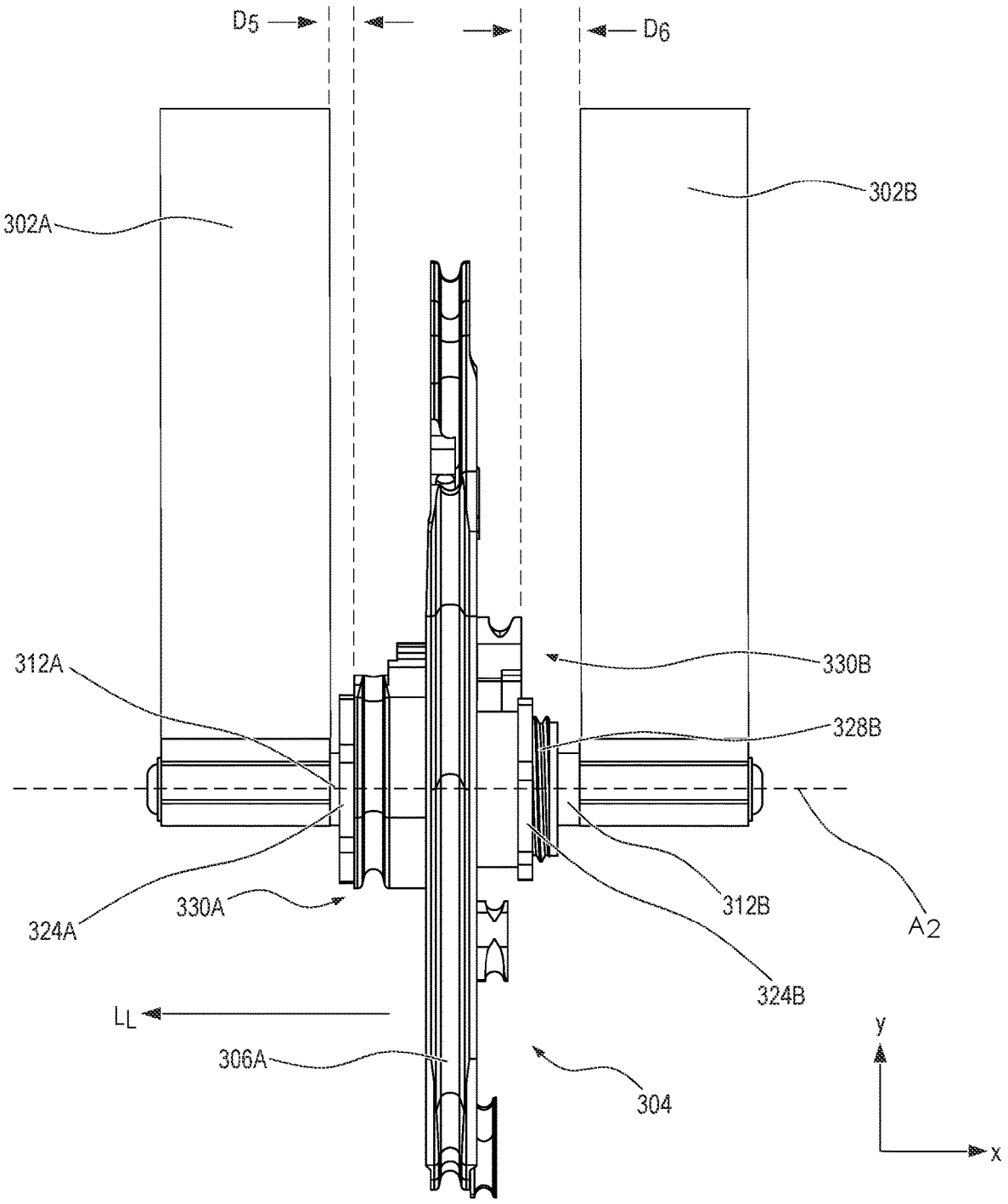
FIG. 3D is a rear view of the cam assembly and the limbs in a first configuration, according to some embodiments.

FIG. 3D shows the rotatable member 304 in a first configuration relative to the bearing carriage assembly 314. The first configuration can correlate to a first position of a plurality of positions of the rotatable member 304 relative to the bearing carriage 320, the one or more bearings 310A, 310B, the first limb 302A, the second limb 302B, or a combination thereof. In other words, the position of the rotatable member 304 is laterally varied along the axis of rotation while the bearing carriage 320, the one or more bearings 310A, 310B, the first limb 302A, the second limb 302B, and the axle 308 all remain substantially laterally unmoved or unchanged along the axis of rotation (see axis of rotation $A_2$ in FIG. 1B). By varying the lateral position of the rotatable member 304 an extent to which the rotatable member 304 leans or cants can be varied to impact or influence shooting characteristics of the archery bow. For example, the bowstring plane P (see FIG. 1B) can be altered or varied to beneficially affect the orientation (e.g., yaw and roll) of the rotatable member 304 while the arrow decouples from the bowstring. Altering or varying the yaw and/or roll of the rotatable member 304 can vary the loading path exerted on the arrow by the bowstring.

In some examples, the rotatable member 304 can be laterally translated or laterally repositioned in the lateral left direction (as designated by the arrow $L_L$) such that the bowstring groove 306A is shifted or moved toward the first limb 302A and away from the second limb 302B. Shifting or repositioning the rotatable member 304 relatively closer to the first limb 302A can alter or vary a moment induced on the cam assembly 300 and therefore alter or vary a lean or camber of the cam assembly 300.

In the first position or first configuration, a first lateral side 330A of the rotatable member 304 is disposed a fifth distance $D_5$ from the first limb 302A while a second lateral side 330B of the rotatable member 304 is disposed a sixth distance $D_6$ from the second limb 302B. In some examples, the fifth distance $D_5$ can be less than the sixth distance $D_6$. Meanwhile, the one or more bearings 310A, 310B can remain a fixed distance relative to the limbs 302A, 302B (e.g., a distance between the bearing and a respective limb remains unchanged regardless of the configuration of the rotatable member).

In some examples, the fifth distance $D_5$ can be equivalent or substantially equivalent to the sixth distance $D_6$. The fifth distance $D_5$ can be less than about 1 mm, between about 1 mm and about 3 mm, between about 3 mm and about 5 mm, between about 5 mm and about 8 mm, or greater than about 8 mm. The sixth distance $D_6$ can be less than about 2 mm, between about 2 mm and about 4 mm, between about 4 mm and about 7 mm, between about 7 mm and about 10 mm, or greater than about 10 mm. The first lateral side 330A of the rotatable member 304 can be any lateral-facing surface of the rotatable member 304 facing the lateral left direction $L_L$, such as, a lateral or sideward facing surface of the rotatable member 304, a module, a fastener, a bearing, a pin, a damper, or any other cam component that may be affixed to the rotatable member 304. Similarly, the second lateral side 330B of the rotatable member 304 can be any lateral-facing surface of the rotatable member 304 facing the lateral right direction $L_R$, such as, a lateral or sideward facing surface of the rotatable member 304, a module, a fastener, a bearing, a pin, a damper, or any other cam component that may be affixed to the rotatable member 304.

Figure 3E:
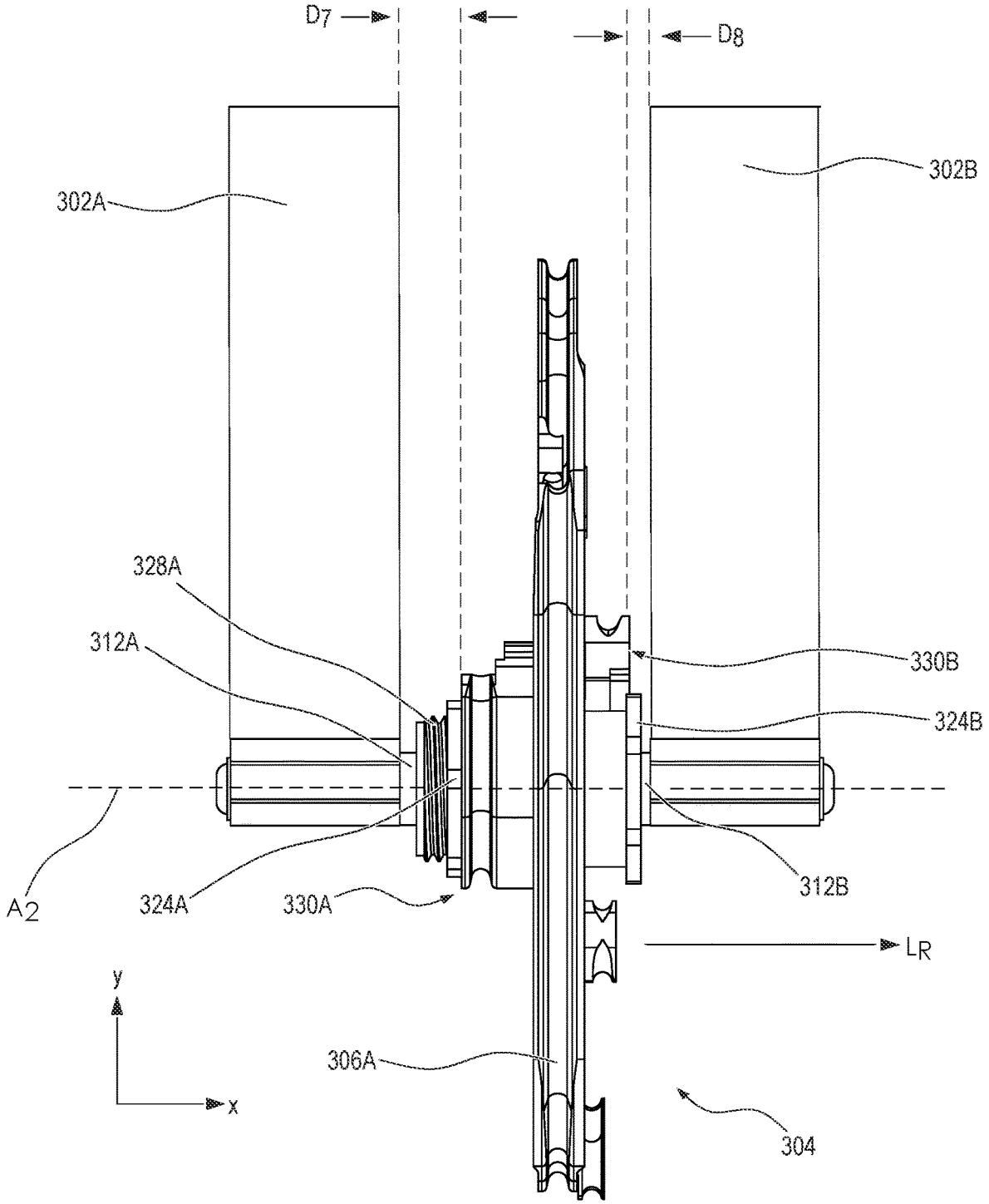
FIG. 3E is a rear view of the cam assembly and the limbs in a second configuration, according to some embodiments.

FIG. 3E shows the rotatable member 304 in a second configuration relative to the bearing carriage assembly 314. The second configuration can correlate to a second position of a plurality of positions of the rotatable member 304 relative to the bearing carriage 320, the one or more bearings 310A, 310B, the first limb 302A, the second limb 302B, or a combination thereof. In other words, the position of the rotatable member 304 is laterally varied along the axis of rotation $A_2$ while the bearing carriage 320, the one or more bearings 310A, 310B, the first limb 302A, the second limb 302B, and the axle 308 all remain substantially laterally unmoved or unchanged along the axis of rotation $A_2$. By varying the lateral position of the rotatable member 304 an extent to which the rotatable member 304 leans or cants can be varied to impact or influence shooting characteristics of the archery bow. For example, the bowstring plane P (see FIG. 1B) can be altered or varied to beneficially affect the orientation (e.g., yaw and roll) of the rotatable member 304 while the arrow decouples from the bowstring. Altering or varying the yaw and/or roll of the rotatable member 304 can vary the loading path exerted on the arrow by the bowstring.

In some examples, the rotatable member 304 can be laterally translated or laterally repositioned in the lateral right direction (as designated by the arrow $L_R$) such that the bowstring groove 306A is shifted or moved toward the second limb 302B and away from the first limb 302A. Shifting or repositioning the rotatable member 304 relatively closer to the second limb 302B can alter or vary a moment induced on the cam assembly 300 and therefore alter or vary a lean or camber of the cam assembly 300.

In the second position or second configuration, the first lateral side 330A of the rotatable member 304 is disposed a seventh distance $D_7$ from the first limb 302A while the second lateral side 330B of the rotatable member 304 is disposed an eighth distance $D_8$ from the second limb 302B. In some examples, the seventh distance $D_7$ can be greater than the eighth distance $D_8$. In some examples, the fifth distance $D_5$ can be less than the seventh distance $D_7$. In some examples, the eighth distance $D_8$ can be less than the sixth distance $D_6$. In some examples, the seventh distance $D_7$ can be equivalent or substantially equivalent to the eighth distance $D_8$. The seventh distance $D_7$ can be less than about 2 mm, between about 2 mm and about 4 mm, between about 4 mm and about 7 mm, between about 7 mm and about 10 mm, or greater than about 10 mm. The eighth distance $D_8$ can be less than about 1 mm, between about 1 mm and about 3 mm, between about 3 mm and about 5 mm, between about 5 mm and about 8 mm, or greater than about 8 mm.

While the rotatable member 304 is shown in only two positions or configurations, in some examples, the two positions or configurations shown in FIGS. 3D and 3E can represent lateral limits to a range of adjustment the rotatable member 304 is capable of undertaking. For example, the first configuration shown in FIG. 3D can be a maximum left-most position of the rotatable member 304 and the rotatable member 304 can be repositioned or shifted to the right through a plurality of positions until the rotatable member 304 reaches the second configuration shown in FIG. 3E (e.g., a maximum right-most position of the rotatable member 304). In other words, the rotatable member 304 can be disposed at any one of a spectrum of positions extending between the first configuration (FIG. 3D) and the second configuration (FIG. 3E). In some examples, the threaded nature of the engagement formed or defined by the one or more fasteners 324A, 324B and the one or more threaded portions 328A, 328B can facilitate hundreds of positions for the rotatable member 304 relative to the bearing carriage 320 by incremental rotation of the one or more fasteners 324A, 324B. In some examples, therefore, the plurality of positions may include a spectrum of positions rather than a set of discrete positions independent from one another.

In some examples, a total range of adjustment of the rotatable member 304 (e.g., a total travel distance from the left-most position to right-most position) can be less than about 2 mm, between about 2 mm and about 4 mm, between about 4 mm and about 6 mm, between about 6 mm and about 8 mm, or greater than about 8 mm. In some examples, the total range of adjustment of the rotatable member 304 (i.e., a total translation range) can be equal to or less than a total thickness of the one or more cam spacers 312A, 312B (i.e., a total spacer thickness). For example, each of the first and second cam spacers 312A, 312B can have a respective thickness and the total range of adjustment of the rotatable member 304 can be less than or equal to the combined respective thicknesses of the first and second cam spacers 312A, 312B. In some examples, the total spacer thickness of the one or more cam spacers 312A, 312B can be less than about 2 mm, between about 2 mm and about 4 mm, between about 4 mm and about 6 mm, between about 6 mm and about 8 mm, or greater than about 8 mm. In other examples, the total range of adjustment can be less than or equal to a gap between the first and second limbs 302A, 302B (see gap G in FIG. 5E).

Figure 4A:
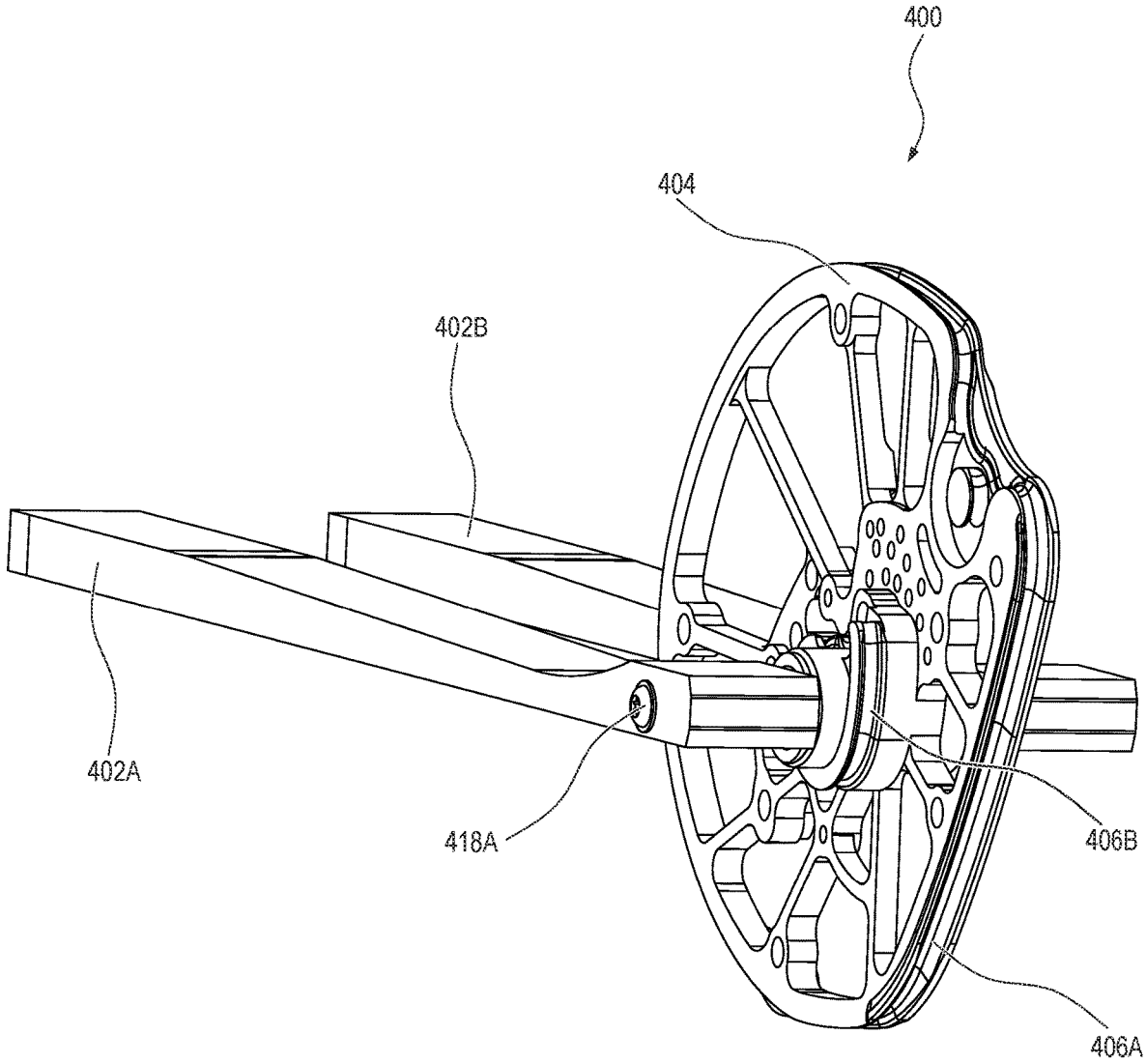
FIG. 4A is a perspective side view of a cam assembly and limbs, according to some embodiments.

FIG. 4A shows a rear view of a cam assembly 400 rotatably coupled to a first limb 402A and a second limb 402B. The cam assembly 400 can be similar to, and can include some or all of the features of, the cam assemblies 116, 118, 200, 300. For example, the cam assembly 400 can include a rotatable member 404. The rotatable member 404 can include a bowstring groove 406A and one or more cable grooves 406B.

Figure 4B:
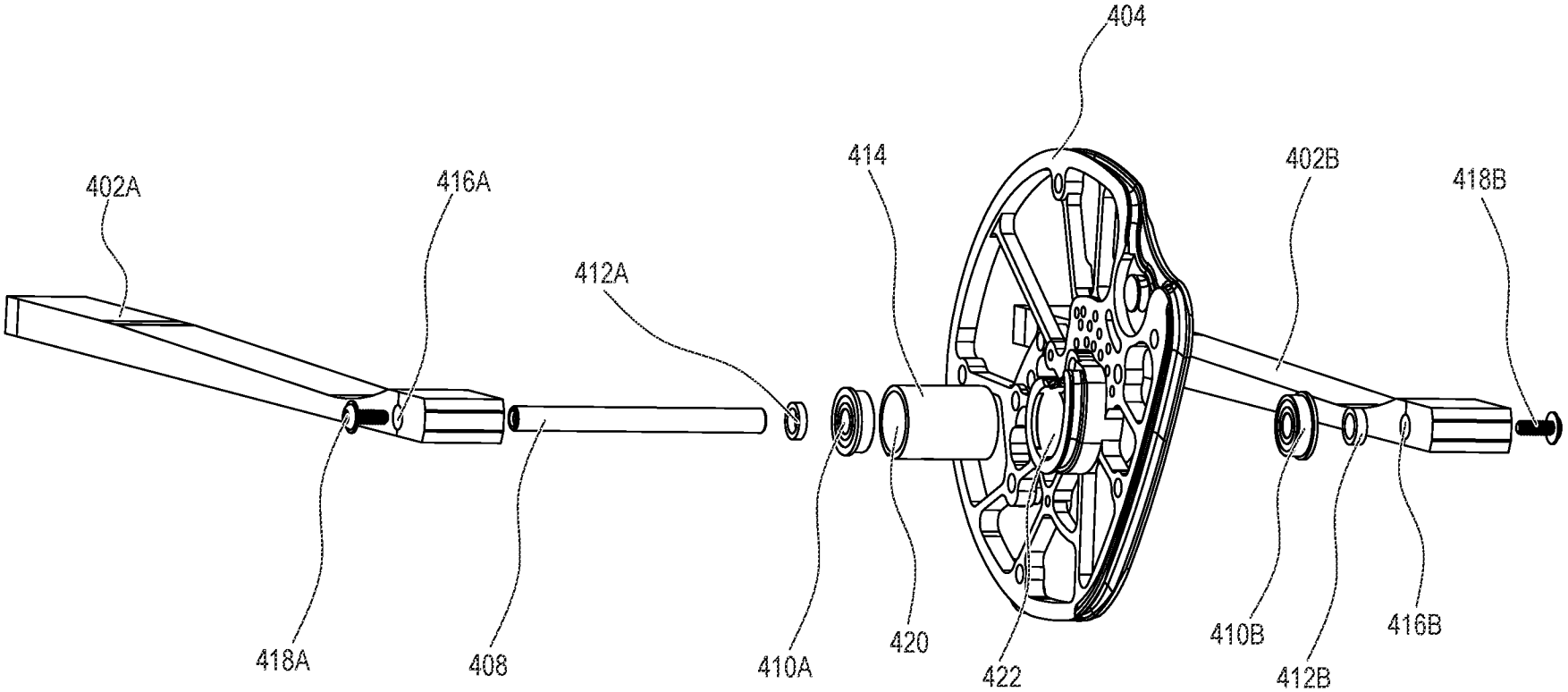
FIG. 4B is an exploded perspective side view of the cam assembly and the limbs, according to some embodiments.
Figure 4C:
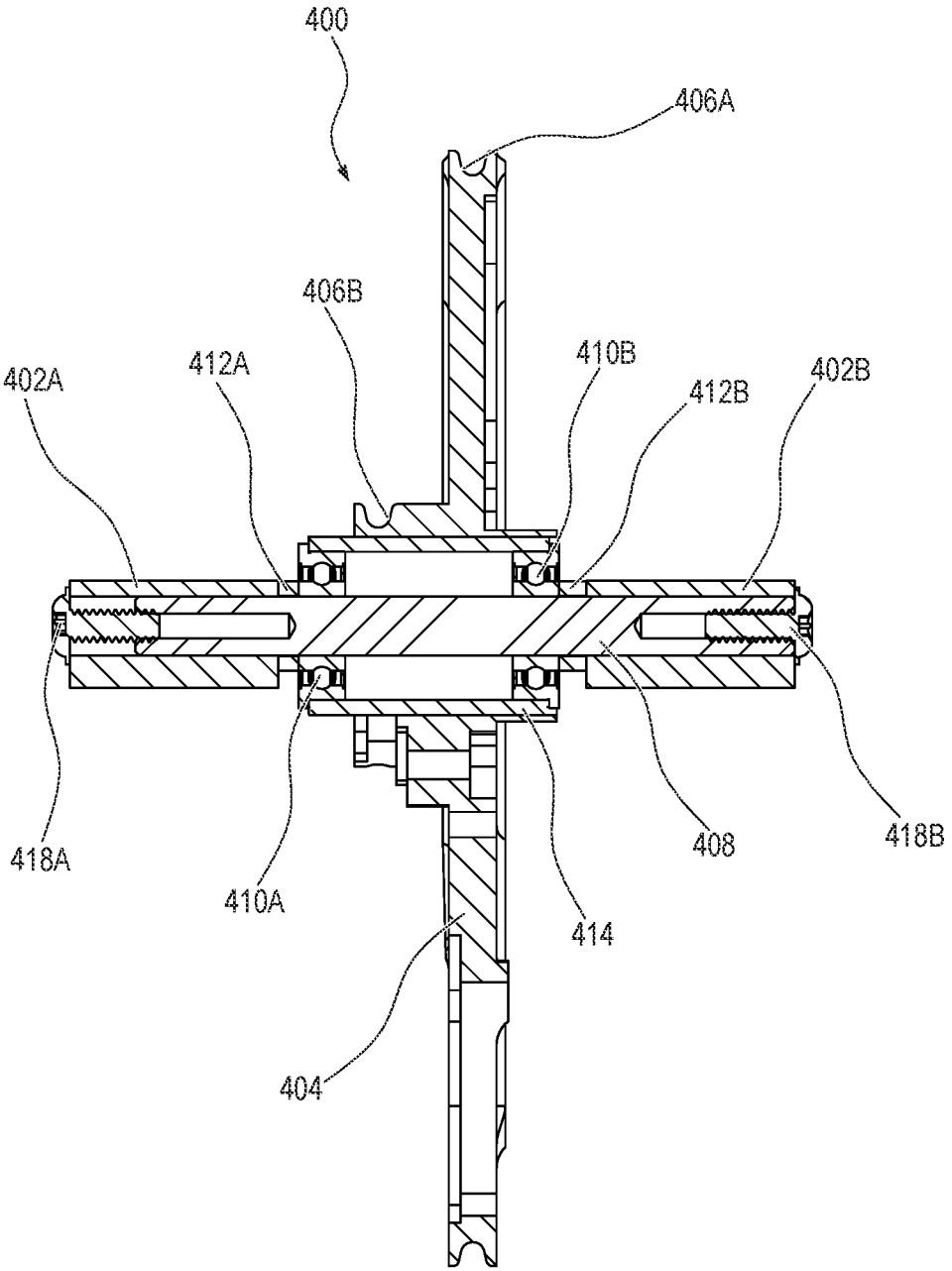
FIG. 4C is a cross-sectional rear view of the cam assembly and the limbs, according to some embodiments.

FIG. 4B shows an exploded view of the cam assembly 400, the first limb 402A, the second limb 402B, and an axle 408. FIG. 4C shows a cross-sectional rear view of the cam assembly 400, the first limb 402A, the second limb 402B, and the axle 408 through a section line positioned similar to the section line SL-SL shown in FIG. 1A (e.g., a section taken of the lower cam assembly through the axis of rotation $A_2$ and parallel to the length of the bowstring 120 extending between the top and bottom cam assemblies 116, 118). The cam assembly 400 can include the rotatable member 404, a first bearing 410A, a second bearing 410B, a first cam spacer 412A, a second cam spacer 412B, and a bearing carriage 414. In some examples, the rotatable member 404 can include one or more additional components associated with archery eccentrics, such as, modules, bolts, fasteners, dampers, pegs, pins, a combination thereof, or any other eccentric component. The axle 408 can extend through the cam assembly 400 and define an axis of rotation. The axle 408 can be retained within holes 416A, 416B in the first and second limbs 402A, 402B. For example, the axle 408 can be partially disposed within each hole 416A, 416B and threadably receive a fastener 418A, 418B to interlock the cam assembly 400, the first limb 402A, the second limb 402B, and the axle 408. Additionally, or alternatively, the axle 408 can be received within and supported by one or more limb hangers (see FIGS. 5A-5E). While the fasteners 418A, 418B are shown as bolts in FIGS. 4A-4C, the fasteners can be any fasteners, such as, bolts, set screws, snap rings, nuts, clips, pins, rivets, a combination thereof, or any other type of fastener.

In some examples, the bearing carriage 414 can have a bore 420. In some examples, the bearing carriage 414 can be cylindrical or otherwise have a circular cross-sectional shape. In other examples, the bearing carriage can be cuboid or otherwise have a rectangular or square cross-sectional shape. The bearing carriage 414 can have any shape including cylindrical, cuboid, prismatic, hexagonal, spherical, hemispherical, a combination thereof, or any other three-dimensional shape.

In some examples, the one or more bearings 410A, 410B can be at least partially disposed within the bore 420. For example, the one or more bearings 410A, 410B can be press-fit within the bore 420. In some examples, three or more bearings can be disposed within the bore 420 of the bearing carriage 414. One or more of the components of the bearing carriage 414 can include or define concentric through-holes which allow the axle 408 to extend through the bearing carriage 414. In some examples, the first cam spacer 412A can be disposed adjacent the first bearings 410A on the axle 408 when the cam assembly 400 is rotatably coupled to the limbs 402A, 402B. In some examples, the second cam spacer 412B can be disposed adjacent the second bearings 410B on the axle 408 when the cam assembly 400 is rotatably coupled to the limbs 402A, 402B.

The bearing carriage 414 can be at least partially disposed within a bore 422 of the rotatable member 404 (see FIG. 4B). The bearing carriage 414 can be removable from the bore 422. In some examples, the one or more bearings 410A, 410B can remain disposed within the bearing carriage 414 when the bearing carriage 414 is removed from the bore 422. The bore 422 can have a cross-sectional shape that at least partially conforms to a cross-sectional shape of the bearing carriage 414 such that at least a portion of the bearing carriage 414 can be received by and disposed within the bore 422. The bore 422 can be a through-hole as depicted in FIG. 4B in some examples. In some examples, the bore 422 can be a blind-hole. In some examples, a periphery of the bore 422 (e.g., an inner surface of the rotatable member 404 that defines or forms the bore 422) can vary such that the bore 422 does not have a continuous cross-sectional shape along a width of the rotatable member 404 (see bore 234 on FIG. 2D). In some examples, at least a section of the bore 422 can be concentric or substantially concentric about an axis of rotation (see e.g., axes $A_1$, $A_2$, $A_3$) the rotatable member 404 rotates about. For example, between 50% and 90% of the inner surface of the rotatable member 404 that defines the bore 422 can have a constant radius relative to the axis of rotation. The other portions of the inner surface of the rotatable member 404 that define the bore 422 that do not have a constant radius can form features such as splines, keyways, blind-holes, through-holes, threaded apertures, chamfers, bevels, combinations thereof, or any other feature.

In some examples, the bearing carriage 414 can be removably coupled within the bore 422 without requiring removal of the one or more bearings 410A, 410B from the bearing carriage 414. In other words, the bearing carriage 414 can act as a replaceable or swappable bearing cartridge or bearing clip. The bearing carriage 414 can house the one or more bearings 410A, 410B and enable bearing removal from the rotatable member 404 without requiring a user to press bearings into, or out of, the bore 422, which can damage the bore 422, the rotatable member 404, the one or more bearings 410A, 410B, or a combination thereof. Instead, the bearing carriage 414 is removable from the bore 422 and a second bearing carriage (having new bearings) can be slid or positioned within the bore 422 to replace the first bearing carriage 414.

In some examples, the bearing carriage 414 can be laterally retained within the bore 422 by one or more fasteners (not shown). Additionally, or alternatively, the bearing carriage 414 can be retained within the bore 422 by one or more features described herein with references to FIGS. 2A-3E. For example, the bearing carriage 414 can be retained within the bore 422 by one or more fasteners (e.g., fasteners 226A, 226B, 324A, 324B). In some examples, the bearing carriage 414 can be rotationally retained or coupled within the rotatable member 404 by one or more fasteners or pins (not shown). For example, the bearing carriage 414 and the rotatable member 404 can define a channel and a pin or other fastener (e.g., see channels 236A, 236B and pin 228A in FIGS. 2D-2G) can be disposed within the channel to rotatably couple the bearing carriage 414 to the rotatable member 404.

Figure 5A:
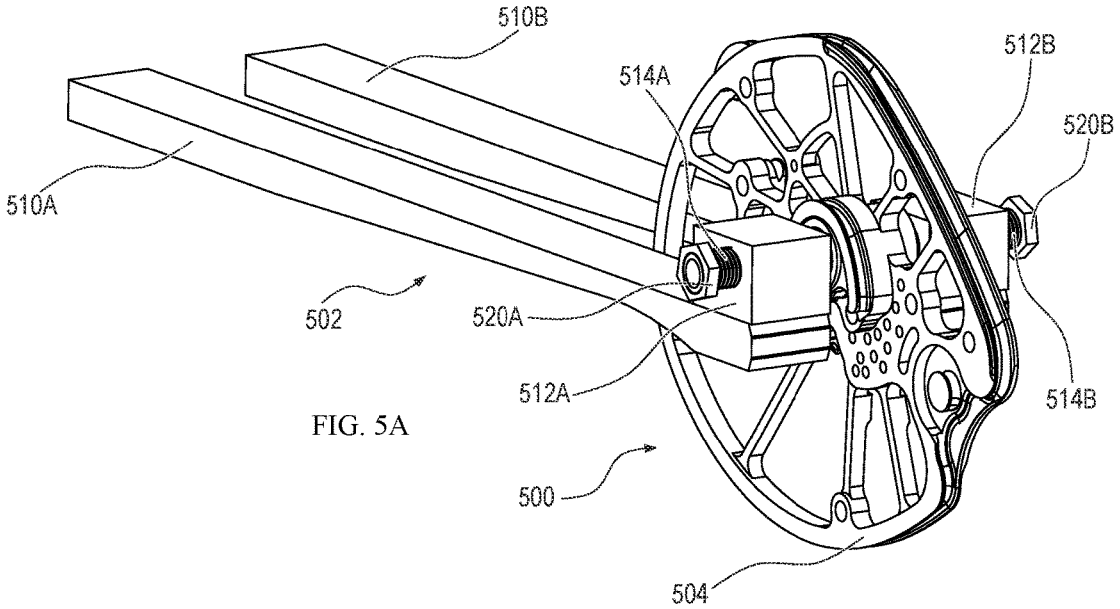
FIG. 5A is a perspective side view of a cam assembly and a limb assembly, according to some embodiments.
Figure 5B:
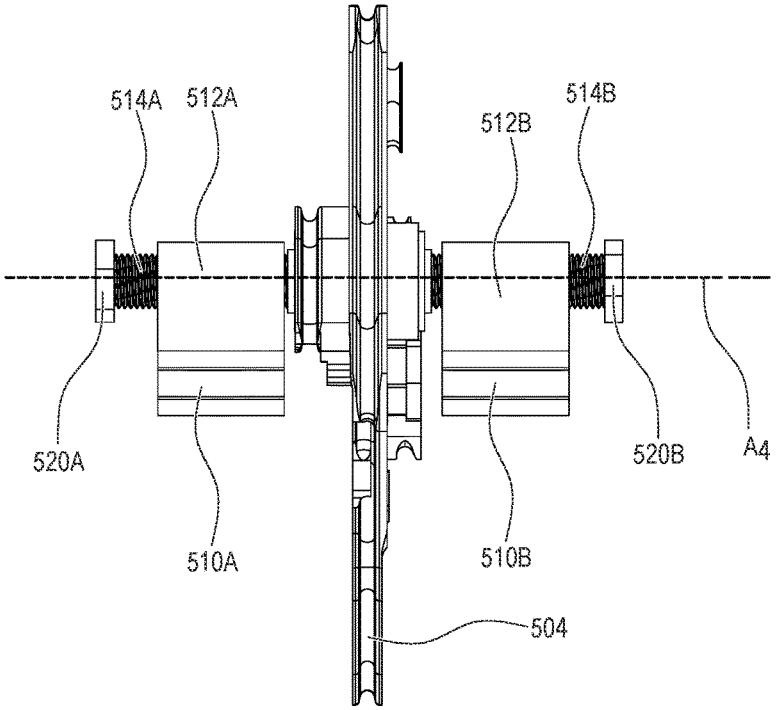
FIG. 5B is a rear view of the cam assembly and the limb assembly, according to some embodiments.
Figure 5C:
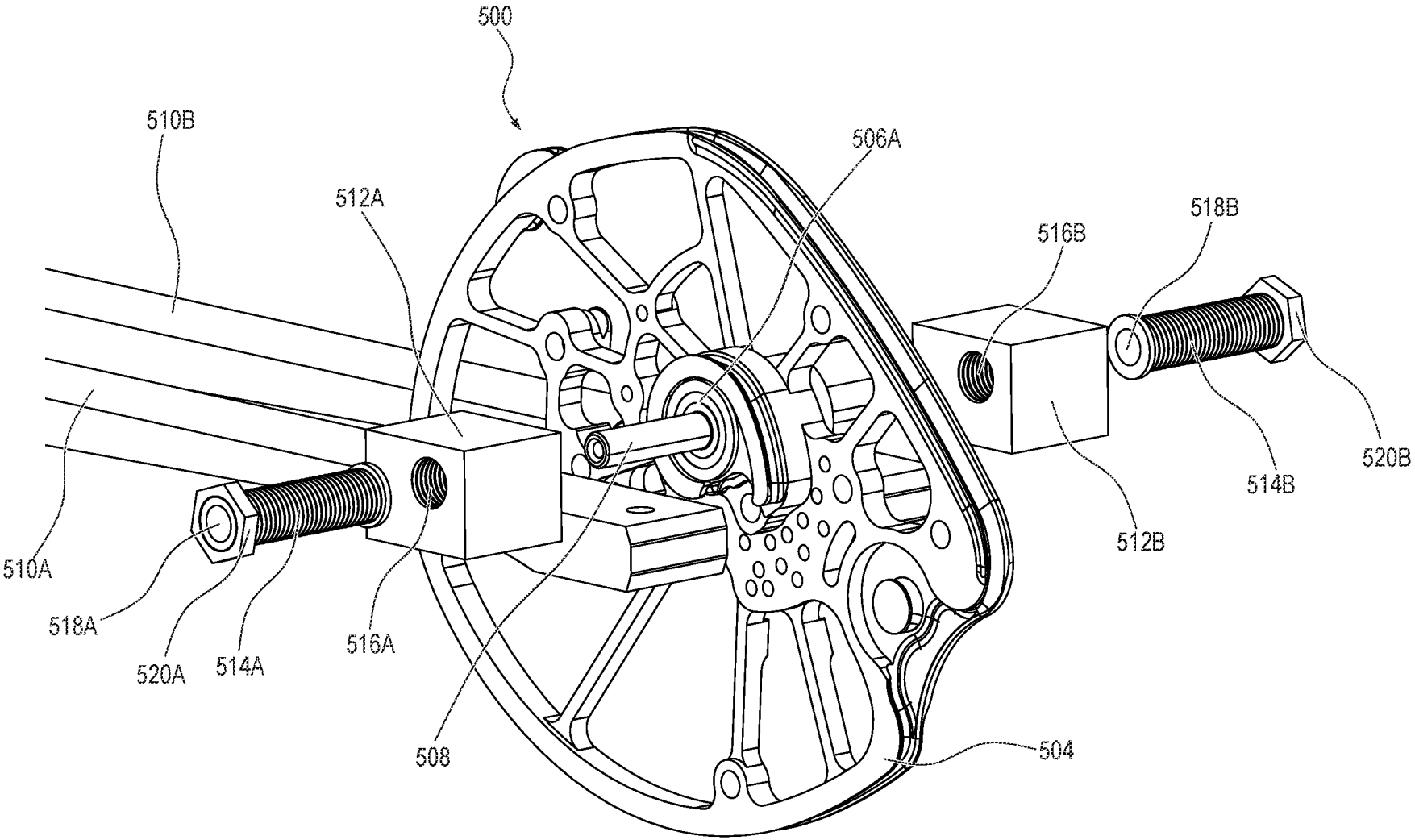
FIG. 5C is an exploded perspective side view of the cam assembly and the limb assembly, according to some embodiments.
Figure 5D:
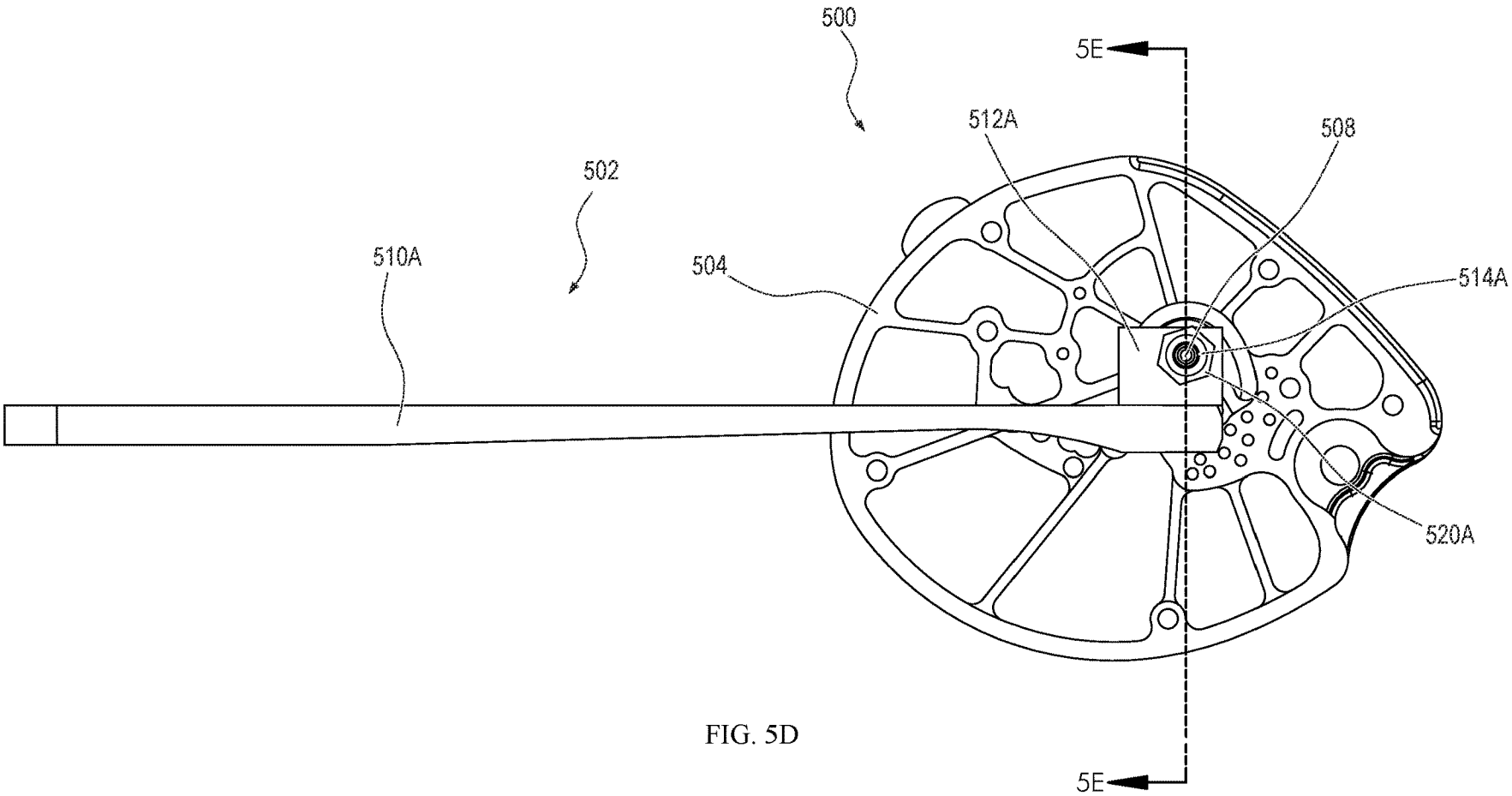
FIG. 5D is a side view of the cam assembly and the limb assembly, according to some embodiments.
Figure 5E:
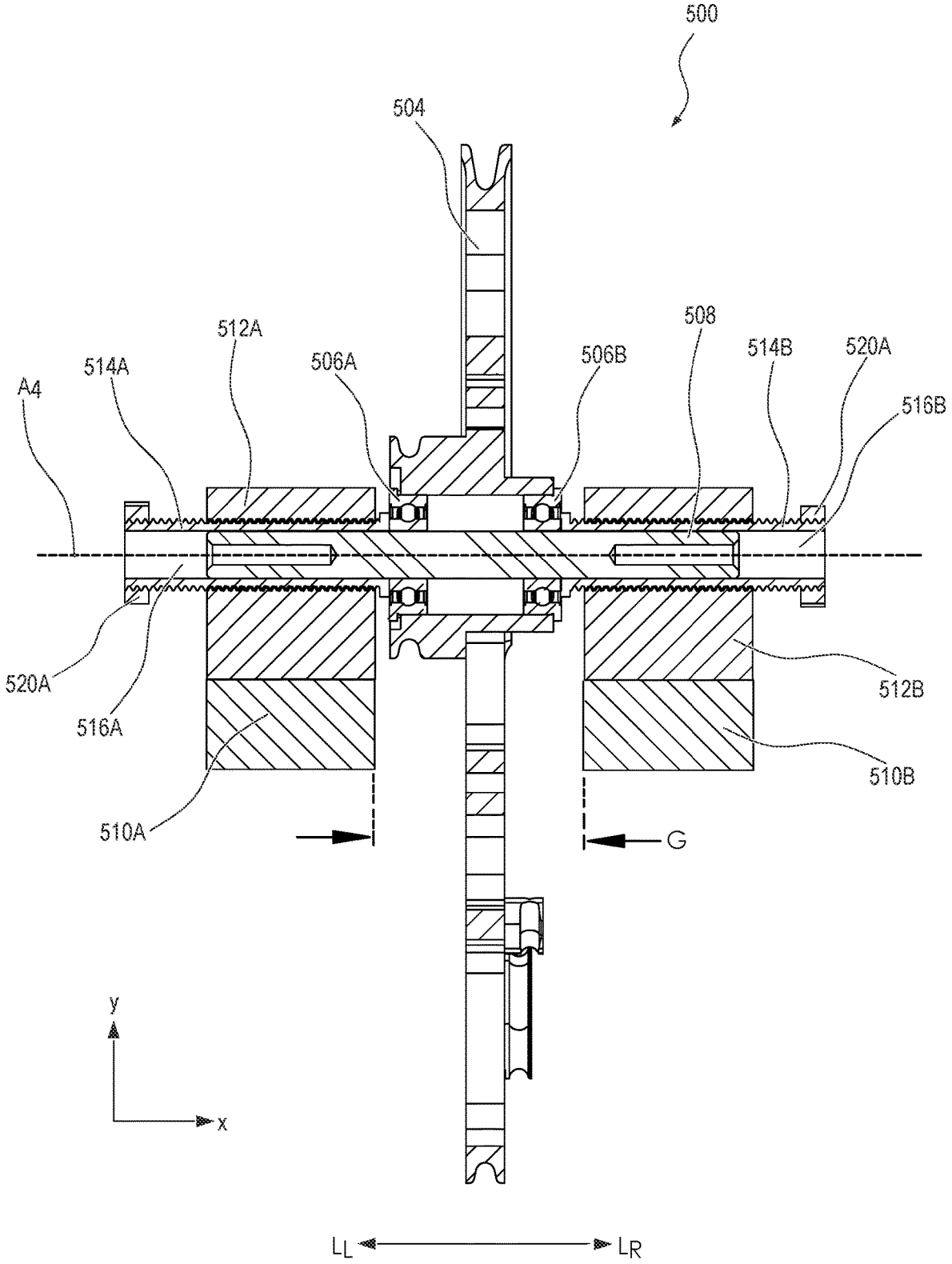
FIG. 5E is a cross-sectional rear view of the cam assembly and the limb assembly, according to some embodiments.

FIG. 5A shows a cam assembly 500 coupled to a limb assembly 502. The cam assembly 500 can include a rotatable member 504, one or more bearings 506A, 506B, and an axle 508 (see FIGS. 5C-5E). The limb assembly 502 can include first and second limbs 510A, 510B, first and second limb hangers 512A, 512B, and first and second bushings 514A, 514B. The cam assembly 500 can be rotatable about an axis $A_4$ defined by the axle 508. For example, the one or more bearings 506A, 506B can be press-fit into a bore of the rotatable member 504 and the axle 508 can be extended through the respective inner races of the one or more bearings 506A, 506B. Additionally, or alternatively, one or more bearings 506A, 506B can be press-fit or otherwise disposed within the first and second bushings 514A, 514B (not shown). For example, a set of bearings 506A, 506B can be disposed within each of the first and second bushings 512A, 512B and the rotatable member 504 can move or translate laterally relative to the first and second bearings 506A, 506B (e.g., move toward or away from the first and second bearings 506A, 506B).

In some examples, the axle 508 can also be disposed within first and second bushings 514A, 514B such that the axis $A_4$ extends through the first and second limb hangers 512A, 512B. For example, the axle 508 can be at least partially disposed within apertures 518A, 518B formed or otherwise defined by the first and second bushings 514A, 514B. The first and second bushings 514A, 514B can be disposed within respective apertures 516A, 516B formed or otherwise defined within each of the first and second limb hangers 512A, 512B. The first and second limb hangers 512A, 512B can be coupled to respective distal ends of the first and second limbs 510A, 510B. For example, each of the first and second limb hangers 512A, 512B can be coupled to a respective limb 510A, 510B by one or more fasteners (not shown).

In some examples, the respective apertures 516A, 516B within the limb hangers 512A, 512B can be threaded, slotted, or otherwise shaped to engage with a corresponding feature of the first and second bushings 514A, 514B. For example, each of the respective apertures 516A, 516B can be threaded to threadably engage with the respective first and second bushings 514A, 514B to enable lateral translation of the respective bushings 514A, 514B relative to the respective limb hanger 512A, 512B (i.e., translation along the axis $A_4$). Lateral translation of the respective bushings 514A, 514B within and relative to the limb hangers 512A, 512B can reposition the rotatable member 504 within a gap G formed between the first and second limbs 510A, 510B and along the axis $A_4$ (see FIG. 5E). In other words, translating the respective bushings 514A, 514B within and relative to the limb hangers 512A, 512B can laterally alter or vary a position of the rotatable member 504 relative to the first and second limbs 510A, 510B. Repositioning the rotatable member 504 along the axis $A_4$ within the gap G can vary the moment(s) induced on the cam assembly 500 while launching an arrow.

In some examples, the first bushing 514A can contact an inner race of the first bearing 506A or otherwise contact a cam spacer (not shown) disposed between the first bushing 514A and the first bearing 506A. Similarly, the second bushing 514B can contact an inner race of the second bearing 506B or otherwise contact a cam spacer (not shown) disposed between the second bushing 514B and the second bearing 506B. To reposition the rotatable member 504 within the gap G and relative to the first and second limb hangers 512A, 512B, the first and second bushings 514A, 514B can be rotated to extend into or retract from the gap G. For example, the second bushing 514B can be rotated to dispose less of the second bushing 514B within the gap G while the first bushing 514A can be rotated to dispose more of the first bushing 514A within the gap G. As such, the rotatable member 504 can be repositioned closer to the second limb hanger 512B than the first limb hanger 512A (i.e., in a laterally right direction $L_R$). Alternatively, the second bushing 514B can be rotated to dispose more of the second bushing 514B within the gap G while the first bushing 514A can be rotated to disposed less of the first bushing 514A within the gap G such that the rotatable member 504 is positioned closer to the first limb hanger 512A than the second limb hanger 512B (i.e., in a laterally left direction $L_L$). While the rotatable member 504 can be repositioned within the gap G (i.e., repositioned relative to the limb hangers 512A, 512B), the axle 508 can remain static or stationary relative to the first and second limb hangers 512A, 512B. In other words, translation of the rotatable member 504 along the axis $A_4$ does not require translation or movement of the axle 508 along the axis $A_4$. Rather, the axle 508 can remain in a fixed position relative to the first and second limb hangers 512A, 512B.

In some examples, each of the first bushing 514A and/or the second bushing 514B can be locked into place by one or more fasteners, such as, a set screw, a nut, a retaining clip, a bolt, a combination thereof, or any other type of fastener. For example, the first bushing 514A can threadably receive a first fastener 520A and the second bushing 514B can threadably received a second fastener 520B to retain the respective bushing 514A, 514B in a desired position relative to the respective limb hangers 512A, 512B. While the first and second fasteners 520A, 520B are shown affixed to portions of the first and second bushings 514A, 514B disposed outside the gap G (i.e., not disposed within the gap G), one or more additional or alternative fasteners can be affixed to portions of the first and second bushings 514A, 514B inside the gap G (e.g., between the first and second bushings 512A, 512B).

Figure 6A:
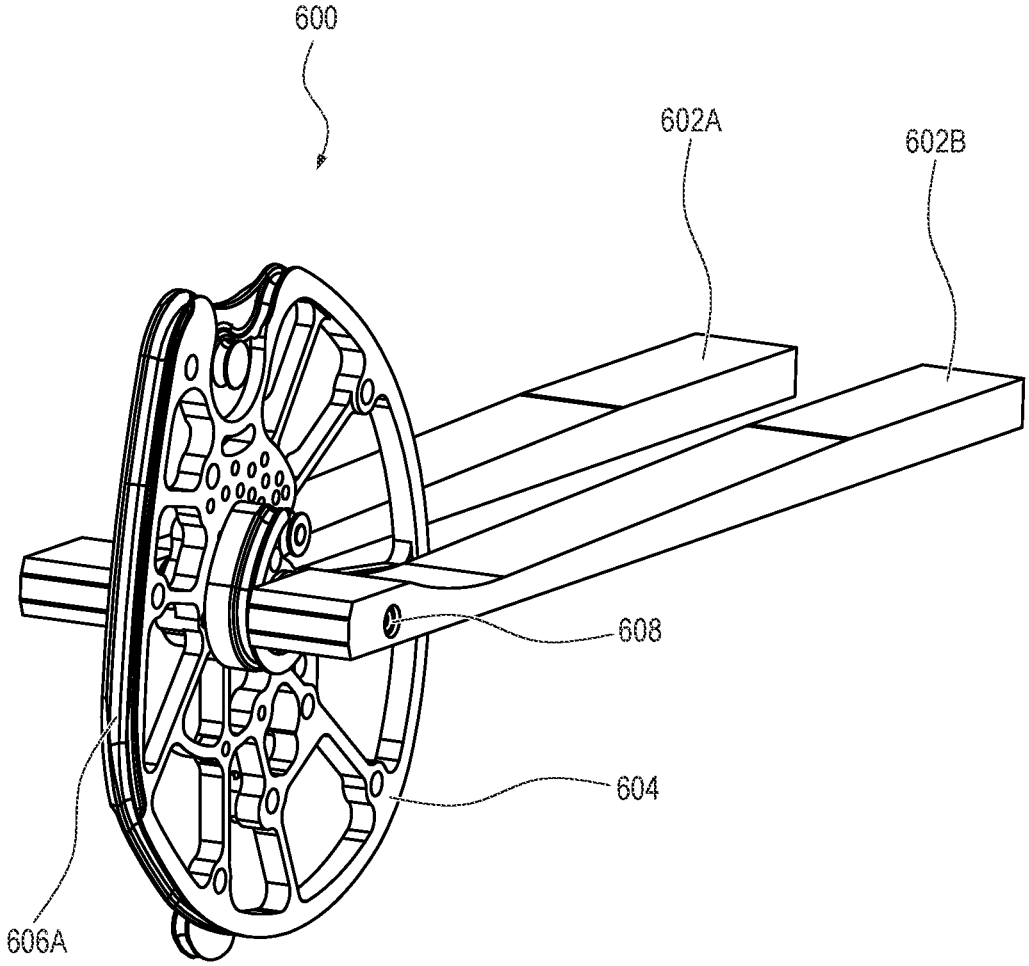
FIG. 6A is a perspective side view of a cam assembly and limbs, according to some embodiments.

FIG. 6A shows a rear view of a cam assembly 600 rotatably coupled to a first limb 602A and a second limb 602B. The cam assembly 600 can be similar to, and can include some or all of the features of, the cam assemblies 116, 118, 200, 300, 400, 500. For example, the cam assembly 600 can include a rotatable member 604 at least partially defining a bowstring plane P and rotatable about an axle 608. The rotatable member 604 can include a bowstring groove 606A and one or more cable grooves 606B (see FIGS. 6E-6G). The bowstring plane P can be at least partially disposed within the bowstring groove 606A. The rotatable member 604 can be repositionable relative to one or more bearings (see FIGS. 6F and 6G) of the cam assembly 600 such that the rotatable member 604 is laterally adjustable or repositionable while the one or more bearings remain laterally fixed or static relative to the axle 608 (e.g., remaining a fixed distance from the first and second limbs 602A, 602B).

Figure 6B:
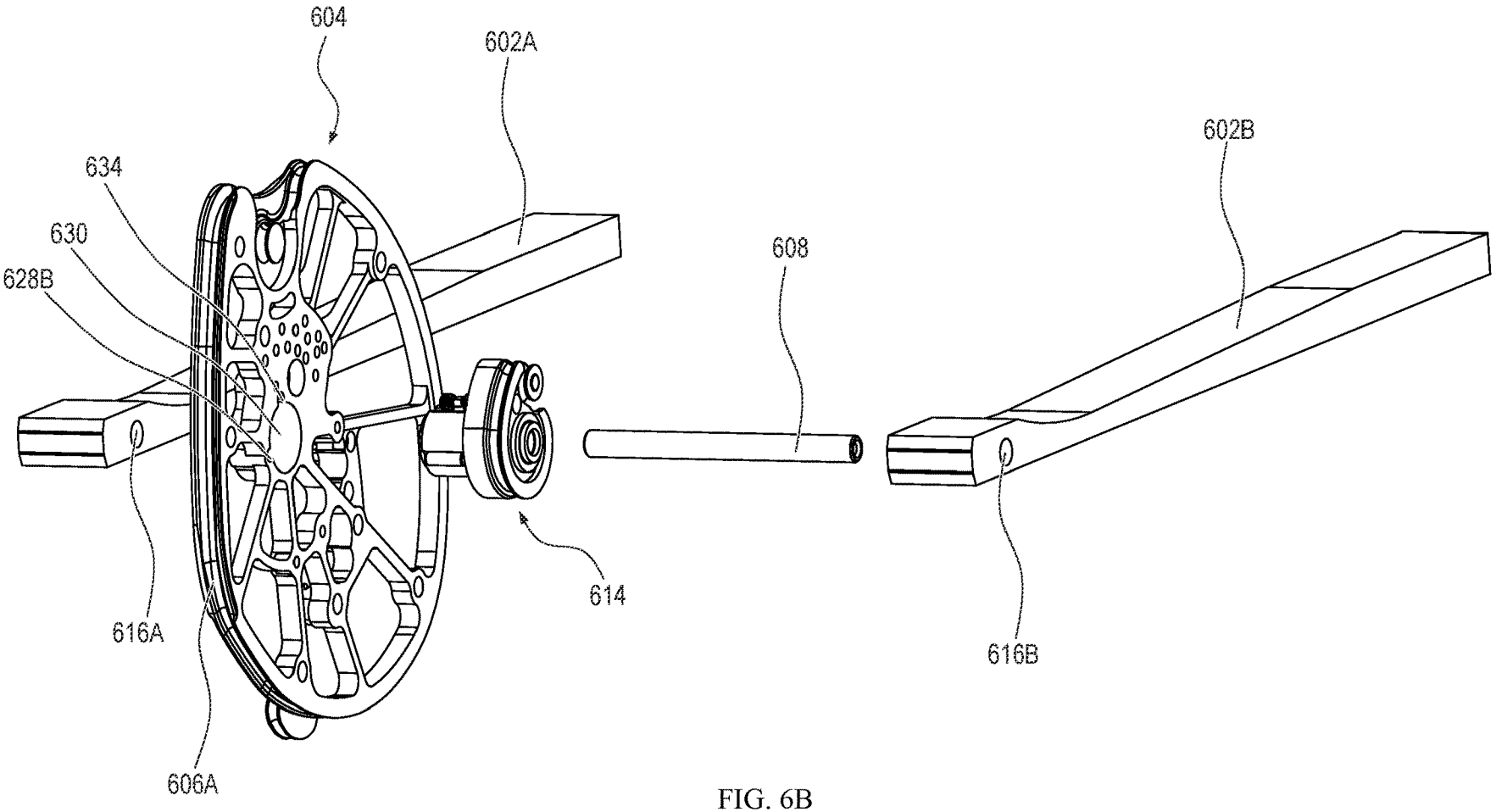
FIG. 6B is an exploded perspective side view of the cam assembly and the limbs, according to some embodiments.

FIG. 6B shows an exploded view of the cam assembly 600, the first limb 602A, the second limb 602B, and the axle 608. The cam assembly 600 can include the rotatable member 604, a first bearing 610A, a second bearing 610B, first and second cam spacers 612A, 612B (see FIG. 6C), and a bearing carriage assembly 614. In some examples, the rotatable member 604 can include one or more additional components associated with archery eccentrics, such as, modules, bolts, fasteners, dampers, pegs, pins, a combination thereof, or any other eccentric component. The axle 608 can extend through the cam assembly 600 and define an axis of rotation $A_5$. As described herein with reference to FIGS. 2A-4C, the axle 608 can be retained within holes 616A, 616B in the first and second limbs 602A, 602B. Additionally, or alternatively, the axle 608 can be received within and supported by one or more limb hangers (see FIGS. 5A-5E).

Figure 6C:
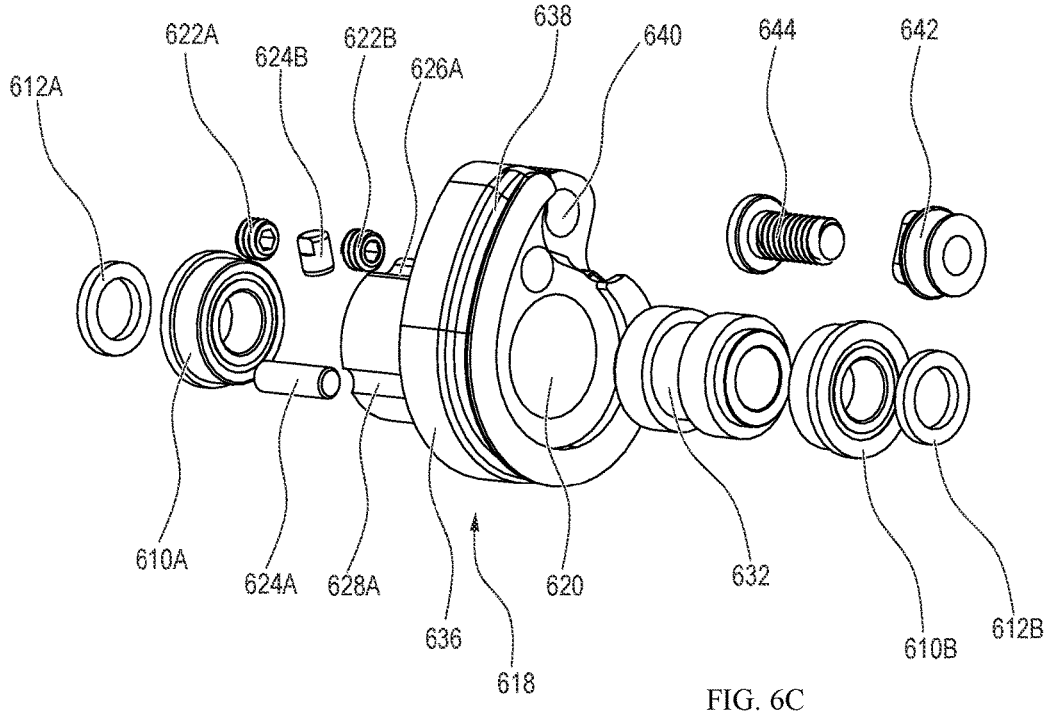
FIG. 6C is an exploded perspective side view of a bearing carriage assembly, according to some embodiments.
Figure 6D:
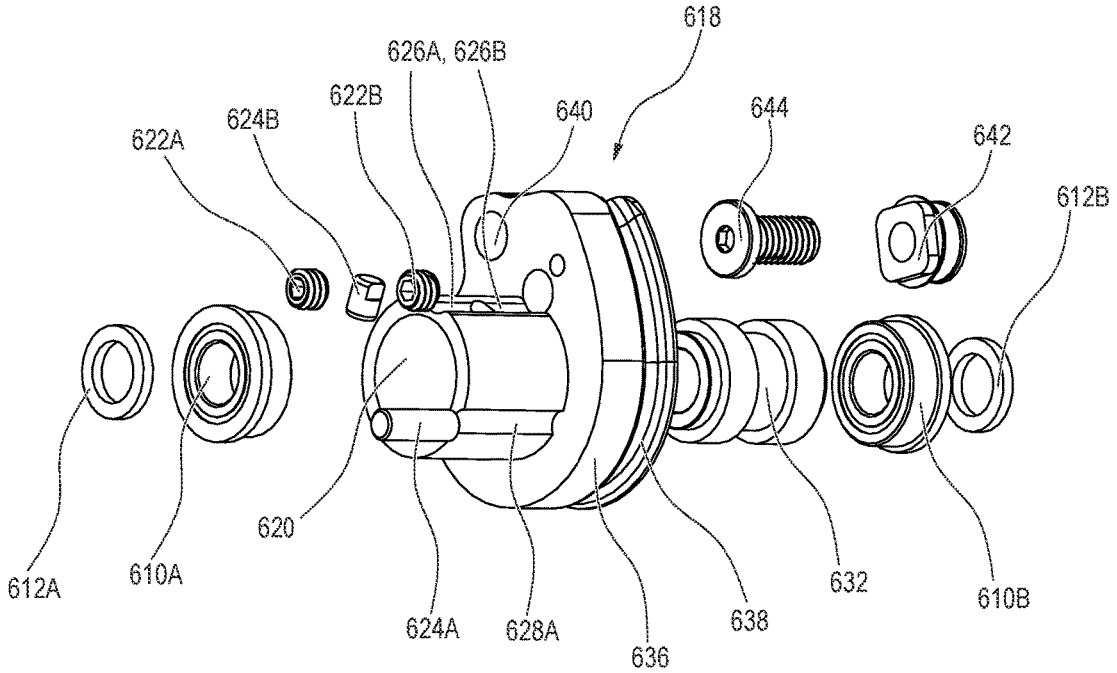
FIG. 6D is another exploded perspective side view of the bearing carriage assembly, according to some embodiments.

FIGS. 6C and 6D show respective exploded views of the bearing carriage assembly 614. In some examples, the bearing carriage assembly 614 can be similar to, and can include some or all of the features of, the bearing carriage assembly 216. For example, the bearing carriage assembly 614 can include a bearing carriage 618 having a bore 620, one or more shared fasteners 622A, 622B, and one or more pins 624A, 624B. Each of the one or more shared fasteners 622A, 622B can be at least partially disposed within one or more channels 626A, 626B formed or defined on the bearing carriage 618 and within one or more threaded channels 634, as described above with reference to FIGS. 2A-2J. The first pin 624A can be at least partially disposed within a first channel 628A defined or formed by the bearing carriage 618 and also partially disposed within a second channel 628B defined or formed within a bore 630 of the rotatable member 604, as described above with reference to FIGS. 2A-2J. As such, the one or more shared fasteners 622A, 622B and the one or more pins 624A, 624B can function as described herein with reference to FIGS. 2A-2J.

In some examples, the one or more bearings 610A, 610B and a bearing spacer 632 can be at least partially disposed within the bore 620. For example, the one or more bearings 610A, 610B can be press-fit within the bore 620 and the bearing spacer 632 can be disposed between the bearings 610A, 610B within the bore 620. In some examples, the bearings 610A, 610B can be displaced from one another by a gap or distance (e.g., a width of the bearing spacer 632) and that gap or distance can be greater than or equal to 55% of a gap or distance between the first limb 602A and the second limb 602B (see gap G in FIG. 5E). In some examples, the gap or distance between the bearings 610A, 610B can be at least 13 mm, between about 13 mm and about 17 mm, between 17 mm and about 21 mm, between about 21 mm and about 25 mm, or greater than about 25 mm. In some examples, the gap or distance between the limbs 602A, 602B can be at least 23 mm, between about 23 mm and about 28 mm, between 28 mm and about 33 mm, between about 33 mm and about 38 mm, or greater than about 38 mm. The gap or distance between the bearings 610A, 610B can be greater than about 55%, between about 55% and about 65%, between 65% and about 75%, between about 75% and about 85%, or greater than about 85% of the gap or distance between the limbs 602A, 602B (see FIG. 5E).

The bearing carriage 618 can be at least partially disposed within the bore 630 of the rotatable member 604 (see FIG. 6B). The bearing carriage 618 can be removable from the bore 630. In some examples, the one or more bearings 610A, 610B can remain disposed within the bearing carriage 618 when the bearing carriage 618 is removed from the bore 630. While the bearing carriage 618 is disposed within the bore 630, the first pin 624A can engage the first channel 628A, the second channel 628B, or a combination of the first and second channel 628A, 628B to clock or orient the bearing carriage 618 relative to the rotatable member 604.

In some examples, the rotatable member 604 can be laterally adjustable or movable between a plurality of positions as described herein with reference to FIGS. 2I and 2J. For example, when rotated, the one or more shared fasteners 622A, 622B can threadably engage the threaded channel 634 of the rotatable member 604 to cause the rotatable member 604 to laterally translate to one of a plurality of positions along the axis of rotation $A_5$ and relative to the bearing carriage 618.

In some examples, the bearing carriage 618 can include one or more cable groove members 636 extending, at least partially, around the bearing carriage 618 and configured to receive a portion of a cable (e.g., one of the first and second cables 122, 124) within a track or cable groove 638. For example, the one or more tracks or cable grooves 638 can entrain (i.e., take-up) and/or unwind (i.e., let-out) a length of the cable, when the bearing carriage 618 rotates about the axle 608 as the archery bow transitions between a drawn state and a brace state. In some examples, the cable groove member 636 can be integrally formed with the bearing carriage 618 as a singular component of the bearing carriage assembly 614. In some examples, the cable groove member 636 can be separable and distinct from the bearing carriage 618 such that the cable groove member 636 can be removably affixed to the bearing carriage 618. For example, the bearing carriage 618 can define a sleeved portion that can be slid or slipped into a bore defined by the cable groove member 636.

In some examples, the cable groove member 636 can define one or more features, such as apertures, capable of receiving fasteners or other components of the bearing carriage assembly 614. For example, the cable groove member 636 can include an aperture 640 for coupling a cable peg 642 to the cable groove member 636. The cable peg 642 can threadably engage a fastener 644 disposed within the aperture 640. Additionally, or alternatively, one or more cable pegs 642 can be integrally formed on the cable groove member 636. While only one cable groove member 636 is shown in FIGS. 6A-6G, the bearing carriage assembly 614 can include two or more cable groove members 636 in other examples, such as, a pair of cable groove members 636 disposed on opposing lateral sides of the bearing carriage 618.

Figure 6E:
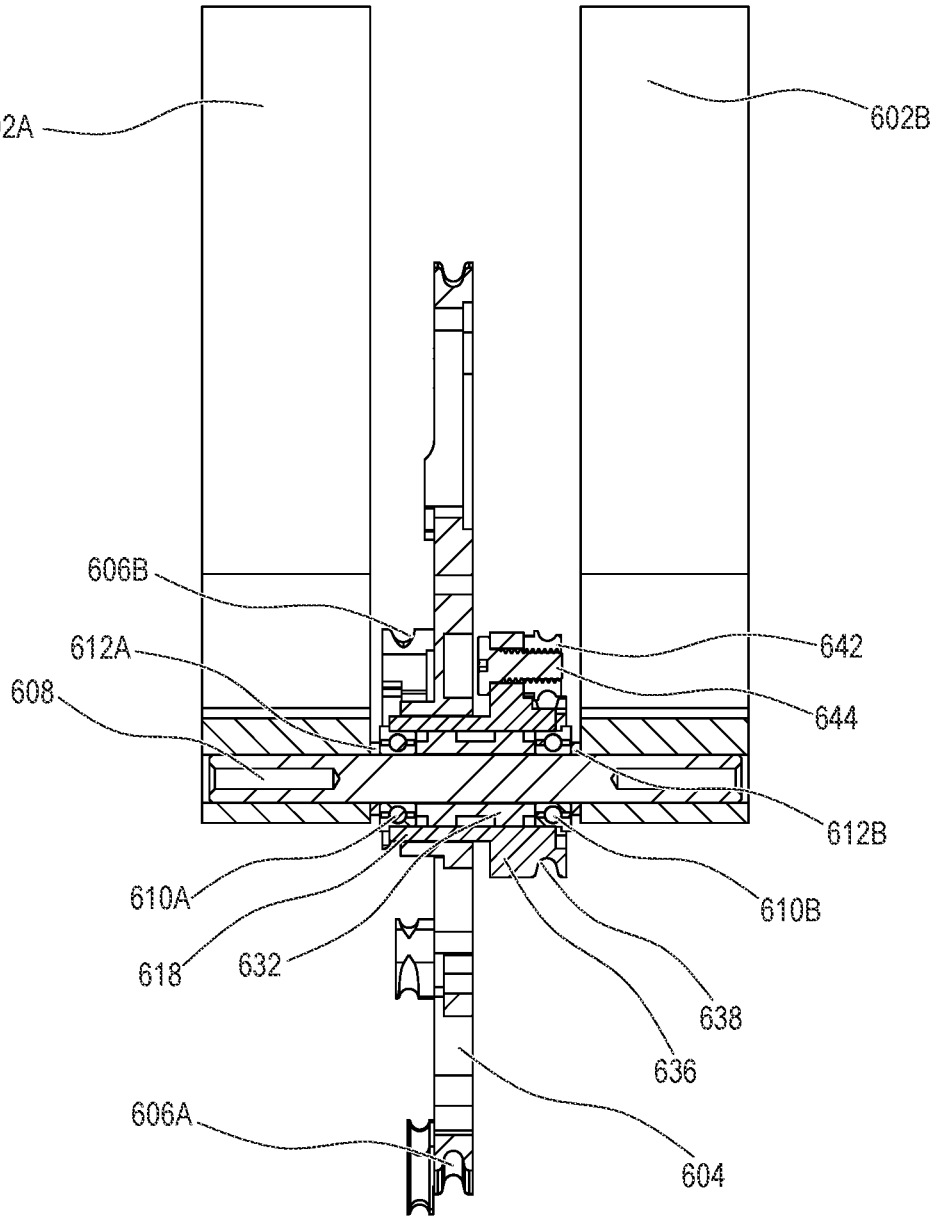
FIG. 6E is a cross-sectional rear view of the cam assembly and limbs, according to some embodiments.

FIG. 6E shows a cross-sectional rear view of the cam assembly 600, the first limb 602A, the second limb 602B, and the axle 608 through a section line positioned similar to the section line SL-SL shown in FIG. 1A (e.g., a section taken of the lower cam assembly through the axis of rotation $A_2$ and parallel to the length of the bowstring 120 extending between the top and bottom cam assemblies 116, 118). Varying a position of the rotatable member 604 relative to the cable groove member 636 will be described in addition detail herein with reference to FIGS. 6F and 6G.

The rotatable member 604 can move or translate along the axis of rotation $A_5$ independent of the cable groove member 636. In other words, the cable groove member 636 can be retained in a fixed position relative to the first and second bearings 610A, 610B and/or the first and second limbs 602A, 602B while the rotatable member 604 is repositionable relative to the first and second bearings 610A, 610B and/or the first and second limbs 602A, 602B. Shifting or repositioning the bowstring groove 606A of the rotatable member 604 relative to the cable groove 638 can alter or vary a moment induced on the cam assembly 600 and therefore alter or vary a lean or camber of the cam assembly 600.

Figure 6F:
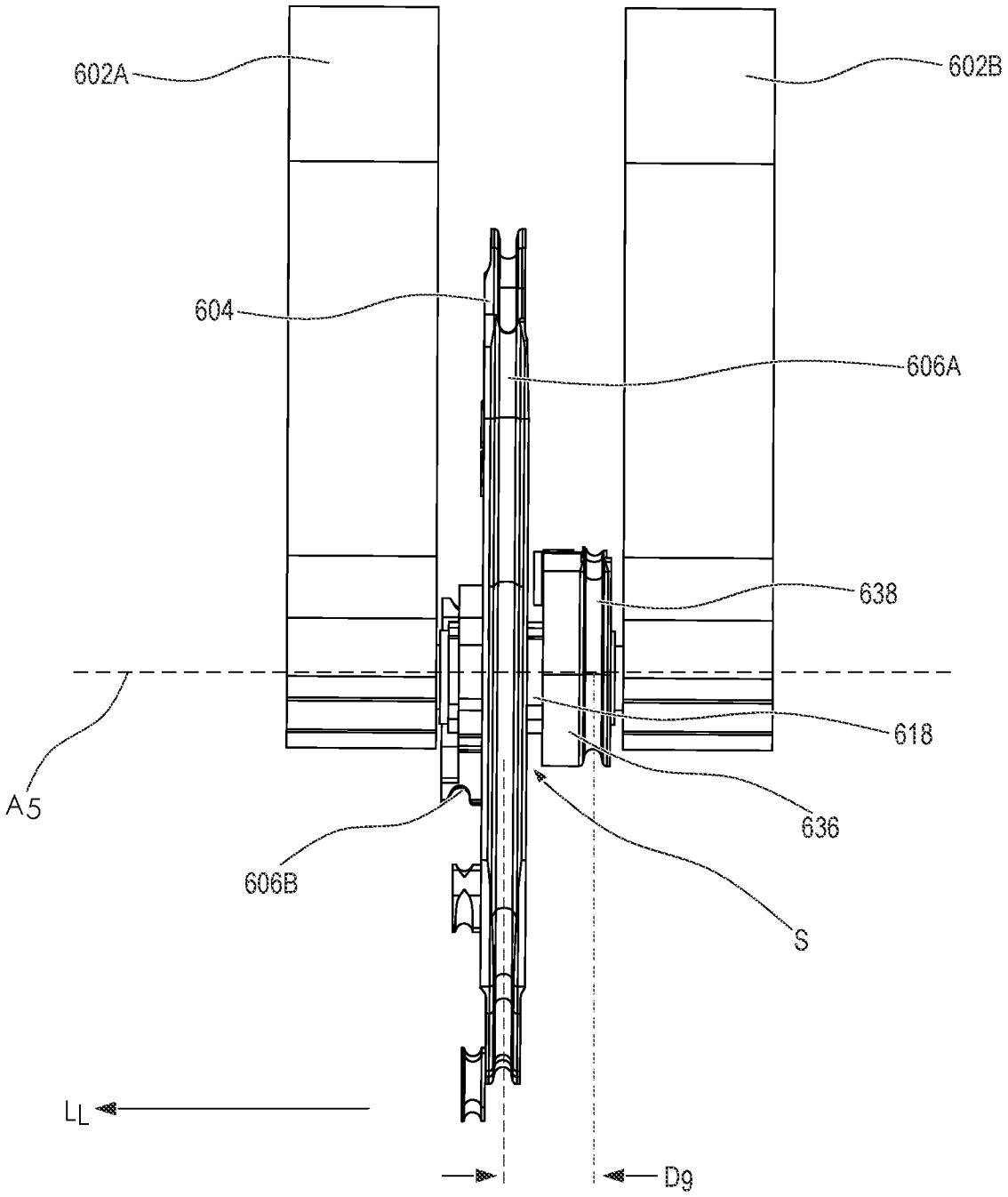
FIG. 6F is a rear view of the cam assembly and the limbs in a first configuration, according to some embodiments.

FIG. 6F shows the rotatable member 604 in a first configuration relative to the bearing carriage assembly 614 wherein the bowstring groove 606A of the rotatable member 604 is disposed a ninth distance Do from the cable groove 638 of the cable groove member 636. The first configuration can correlate to a first position of a plurality of positions of the rotatable member 604 relative to the bearing carriage 618, the one or more bearings 610A, 610B, the first limb 602A, the second limb 602B, or a combination thereof. In other words, the position of the rotatable member 604 is laterally varied along, and extending parallel to, the axis of rotation $A_5$ while the bearing carriage assembly 614, the one or more bearings 610A, 610B, the first limb 602A, the second limb 602B, and the axle 608 all remain substantially laterally unmoved or unchanged along the axis of rotation $A_5$.

Figure 6G:
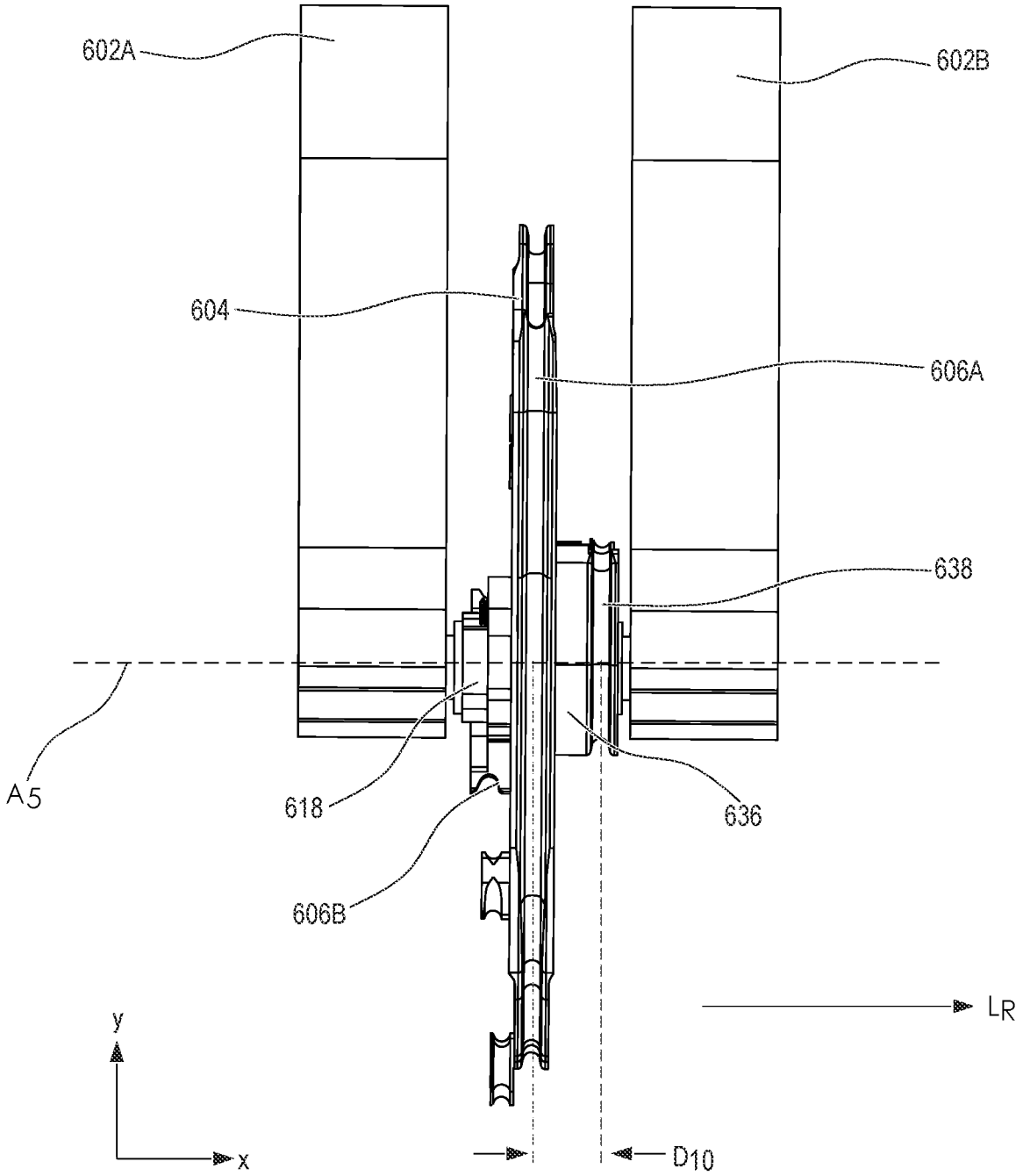
FIG. 6G is a rear view of the cam assembly and the limbs in a second configuration, according to some embodiments.

By varying the lateral position of the rotatable member 604 a distance between the bowstring groove 606A and the cable groove 638 (e.g., distance $D_9$) can be varied to impact or influence shooting characteristics of the archery bow. For example, the bowstring plane P (see FIG. 1B) can be altered or varied to beneficially affect the orientation (e.g., yaw and roll) of the rotatable member 604 while the arrow decouples from the bowstring. Altering or varying the yaw and/or roll of the rotatable member 604 can vary the loading path exerted on the arrow by the bowstring. In some examples, the rotatable member 604 can be laterally translated or laterally repositioned in the lateral left direction (as designated by the arrow $L_L$) such that the bowstring groove 606A is shifted or moved toward the first limb 602A and away from the cable groove 638. Shifting or repositioning the rotatable member 604 relatively further from the cable groove 638 can alter or vary a moment induced on the cam assembly 600 and therefore alter or vary a lean or camber of the cam assembly 600. In some examples, shifting or repositioning the rotatable member 604 relatively further from the cable groove 638 can form a gap or space S between the rotatable member 604 and the cable groove member 636. The space S can be less than about 1 mm, between about 1 mm and about 3 mm, between about 3 mm and about 5 mm, between about 5 mm and about 8 mm, or greater than about 8 mm FIG. 6G shows the rotatable member 604 in a second configuration relative to the bearing carriage assembly 614 wherein the bowstring groove 606A of the rotatable member 604 is disposed a tenth distance $D_{10}$ from the cable groove 638 of the cable groove member 636. The second configuration can correlate to a second position of a plurality of positions of the rotatable member 604 relative to the bearing carriage 618, the one or more bearings 610A, 610B, the first limb 602A, the second limb 602B, or a combination thereof. In some examples, the rotatable member 604 can be laterally translated or laterally repositioned in the lateral right direction (as designated by the arrow $L_R$) such that the bowstring groove 606A is shifted or moved away from the first limb 602A and toward the cable groove 638. Shifting or repositioning the rotatable member 604 relatively closer to the cable groove 638 can alter or vary a moment induced on the cam assembly 600 and therefore alter or vary a lean or camber of the cam assembly 600.

In the first position or first configuration, the ninth distance $D_9$ can be less than about 2 mm, between about 2 mm and about 4 mm, between about 4 mm and about 7 mm, between about 7 mm and about 10 mm, or greater than about 10 mm. The ninth distance Do can be greater than the tenth distance $D_{10}$. In the second position or second configuration, the tenth distance $D_{10}$ can be less than about 1 mm, between about 1 mm and about 3 mm, between about 3 mm and about 5 mm, between about 5 mm and about 8 mm, or greater than about 8 mm.

While the rotatable member 604 is shown in only two positions or configurations, in some examples, the two positions or configurations shown in FIGS. 6F and 6G can represent lateral limits to a range of adjustment the rotatable member 604 is capable of undertaking. For example, the first configuration shown in FIG. 6F can be a maximum left-most position of the rotatable member 604 and the rotatable member 604 can be repositioned or shifted to the right through a plurality of positions until the rotatable member 604 reaches the second configuration shown in FIG. 6G (e.g., a maximum right-most position of the rotatable member 604). In other words, the rotatable member 604 can be disposed at any one of a spectrum of positions extending between the first configuration (FIG. 6F) and the second configuration (FIG. 6G).

In some examples, a total range of adjustment of the rotatable member 604 (e.g., a total travel distance from the left-most position to right-most position) can be less than about 2 mm, between about 2 mm and about 4 mm, between about 4 mm and about 6 mm, between about 6 mm and about 8 mm, or greater than about 8 mm. In some examples, the total range of adjustment of the rotatable member 604 can be equal to or less than a total thickness of the one or more cam spacers 612A, 612B (i.e., a total spacer thickness). For example, each of the first and second cam spacers 612A, 612B can have a respective thickness and the total range of adjustment of the rotatable member 604 (i.e., a total translation range) can be less than or equal to the combined respective thicknesses of the first and second cam spacers 612A, 612B. In some examples, the total spacer thickness of the one or more cam spacers 612A, 612B can be less than about 2 millimeters (mm), between about 2 mm and about 4 mm, between about 4 mm and about 6 mm, between about 6 mm and about 8 mm, or greater than about 8 mm. In other examples, the total range of adjustment can be less than or equal to a gap between the first and second limbs 602A, 602B (see gap G in FIG. 5E).

In some examples, changes may be made in the function and arrangement of archery components or products discussed without departing from the spirit and scope of the disclosure, and various embodiments may omit, substitute, or add other components or accessories as appropriate. For instance, one or more portions incorporated into a particular component described with respect to certain embodiments may be combined in other embodiments.

Various aspects have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed:

1. An archery bow, comprising:
a riser;
a limb;
an axle coupled to the limb, the axle defining an axis; and
a cam assembly rotatably coupled to the axle, comprising:
a rotatable member having a bore; and
a bearing disposed within the bore, wherein the rotatable member is configured to translate relative to the bearing to one of a plurality of positions, the plurality of positions extending along the axis.

2. The archery bow of claim 1, wherein the rotatable member is configured to translate relative to the axle while the bearing remains laterally fixed relative to the axle.

3. The archery bow of claim 1, wherein:
the rotatable member is disposed a first distance from the limb in a first position of the plurality of positions;
the rotatable member is disposed a second distance from the limb in a second position of the plurality of positions; and
the first distance is less than the second distance.

4. The archery bow of claim 3, wherein:
the bearing is disposed a third distance from the limb when the rotatable member is in the first position; and
the bearing is disposed the third distance from the limb when the rotatable member is in the second position.

5. An archery bow comprising:
a riser;
a limb;
an axle coupled to the limb, the axle defining an axis; and
a cam assembly rotatably coupled to the axle, comprising:
a rotatable member having a bore;
a bearing carriage disposed within the bore, the bearing disposed within the bearing carriage; and
a bearing disposed within the bearing carriage, wherein:
the rotatable member is configured to translate relative to the bearing to one of a plurality of positions, the plurality of positions extending along the axis; and
the rotatable member is configured to translate relative to the bearing carriage to one of the plurality of positions.

6. The archery bow of claim 5, wherein the bearing carriage is removable from the bore.

7. The archery bow of claim 5, wherein a shared fastener engages the bearing carriage and the rotatable member, rotation of the shared fastener translates the rotatable member relative to the bearing carriage.

8. The archery bow of claim 5, wherein the bearing carriage has a lateral rim, the lateral rim having a protrusion extending perpendicular to a longitudinal axis of the bearing carriage.

9. The archery bow of claim 5, wherein:
the limb is a first limb and the archery bow further comprises a second limb;
the first limb and the second limb are coupled to an upper portion or a lower portion of the riser;
the cam assembly includes a first spacer and a second spacer, the first spacer has a first thickness, the second spacer has a second thickness, a combination of the first thickness and the second thickness defines a total spacer thickness; and
a total translation range of the rotatable member relative to the bearing is greater than or equal to the total spacer thickness.

10. The archery bow of claim 5, wherein the bearing is a first bearing of a set of bearings disposed within the bore.

11. The archery bow of claim 10, wherein:
the limb is a first limb and the archery bow further comprises a second limb;
the first limb and the second limb are coupled to an upper portion or a lower portion of the riser to form a gap between the first limb and the second limb;
the set of bearings includes a second bearing, the first bearing is displaced from the second bearing by a distance; and
the distance is at least 55% of the gap.

12. The archery bow of claim 11, wherein the distance is at least 13 mm.

13. An archery bow, comprising:
a riser;
a first limb;
a second limb;
an axle coupled to the first limb, the axle defining an axis of rotation; and
a cam assembly rotatably coupled to the axle, comprising:
a bearing coupled to the axle and disposed between the first limb and the second limb;
a rotatable member having a bore, wherein the rotatable member is configured to translate along the axis of rotation while the bearing is configured to remain in a static lateral position relative to the axle.

14. The archery bow of claim 13, wherein:
the cam assembly further comprises a bearing carriage disposed within the bore, the bearing disposed within the bearing carriage; and
the rotatable member is configured to translate along the axis and relative to the bearing carriage to one of a plurality of positions.

15. The archery bow of claim 14, wherein the bearing carriage is removable from the bore.

16. The archery bow of claim 14, wherein a shared fastener engages the bearing carriage and the rotatable member, the shared fastener is configured to rotate to translate the rotatable member relative to the bearing carriage.

* * * * *